US009566817B2

(12) United States Patent
Mayer

(10) Patent No.: US 9,566,817 B2
(45) Date of Patent: Feb. 14, 2017

(54) POP-UP GREETING CARDS

(71) Applicant: American Greetings Corporation, Cleveland, OH (US)

(72) Inventor: David Mayer, Bay Village, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/004,414

(22) Filed: Jan. 22, 2016

(65) Prior Publication Data

US 2016/0159136 A1 Jun. 9, 2016

Related U.S. Application Data

(60) Division of application No. 14/692,358, filed on Apr. 21, 2015, now Pat. No. 9,302,528, which is a continuation-in-part of application No. 14/466,605, filed on Aug. 22, 2014, now Pat. No. 9,027,269, which is a continuation-in-part of application No. 13/470,499, filed on May 14, 2012, now Pat. No. 9,056,517, which is a continuation-in-part of application No. 12/974,287, filed on Dec. 21, 2010, now Pat. No. 8,322,058.

(60) Provisional application No. 61/485,298, filed on May 12, 2011.

(51) Int. Cl.

| | |
|---|---|
| ***B42D 15/02*** | (2006.01) |
| ***B42D 15/04*** | (2006.01) |
| ***F21V 23/04*** | (2006.01) |
| *G09F 1/08* | (2006.01) |
| *B42D 25/20* | (2014.01) |
| *F21Y 101/00* | (2016.01) |

(52) U.S. Cl.

CPC ..... *B42D 15/022* (2013.01); *B42D 15/027* (2013.01); *B42D 15/04* (2013.01); *B42D 15/045* (2013.01); *F21V 23/0407* (2013.01); *B42D 25/285* (2014.10); *F21Y 2101/00* (2013.01); *G09F 1/08* (2013.01)

(58) Field of Classification Search

CPC ..... G09F 1/06; G09F 1/08; G09F 1/04; B42D 15/042; B42D 15/045; A63H 37/00; A63H 13/16

See application file for complete search history.

(56) References Cited

U.S. PATENT DOCUMENTS 4,407,504 A * 10/1983 Popov ..... A63F 9/06 206/1.5
5,608,979 A * 3/1997 Johnson ..... G09F 11/30 40/491
6,761,612 B1 * 7/2004 Pencil ..... A63H 13/16 40/411

(Continued)

*Primary Examiner* — Cassandra Davis
(74) *Attorney, Agent, or Firm* — Christine Flanagan

(57) ABSTRACT

An interactive electronic greeting card with pop-up feature includes a pocket or cavity which houses various electronic and mechanical components and a pop-up element. In a first position, the pop-up element is substantially contained within the greeting card pocket or cavity. When the push button is depressed, the pop-up element is ejected or "pops up" out of the greeting card pocket or cavity, revealing a greeting or other printed indicia, a mobile object or a gift card attached thereto. The push button also initiates play-back of a pre-loaded digital audio file, which may be a spoken message, a sound, a song, music or other such audio recording.

19 Claims, 25 Drawing Sheets

(56) References Cited

U.S. PATENT DOCUMENTS

| | | | | |
|---|---|---|---|---|
| 6,789,773 | B2 * | 9/2004 | Holland | A47G 25/0607<br>248/307 |
| 7,552,553 | B2 * | 6/2009 | Kelly | B42D 15/045<br>40/124.08 |
| 8,615,910 | B2 * | 12/2013 | Glass | G09F 1/04<br>206/449 |
| 2003/0176146 | A1 * | 9/2003 | Norman | A63H 3/18<br>446/310 |
| 2007/0173172 | A1 * | 7/2007 | Yu | A63H 17/21<br>446/303 |
| 2008/0118900 | A1 * | 5/2008 | Salerni | A63H 13/16<br>434/258 |
| 2009/0176438 | A1 * | 7/2009 | Meno | A63H 3/003<br>446/73 |
| 2009/0217559 | A1 * | 9/2009 | Sayre | B42D 15/022<br>40/124.06 |
| 2010/0170822 | A1 * | 7/2010 | Davis | B42D 15/045<br>206/486 |
| 2012/0285861 | A1 * | 11/2012 | Glass | B42D 15/042<br>206/768 |
| 2013/0043156 | A1 * | 2/2013 | Glass | A47F 5/0006<br>206/449 |
| 2013/0273804 | A1 * | 10/2013 | Rossi | A63H 13/16<br>446/310 |
| 2014/0346069 | A1 * | 11/2014 | Pavlu, Jr. | B65D 5/425<br>206/423 |

* cited by examiner

POP-UP GREETING CARDS

RELATED APPLICATIONS

This application is a divisional of U.S. patent application Ser. No. 14/692,358, filed on Apr. 21, 2015, which is a continuation-in-part of U.S. patent application Ser. No. 14/466,605, filed on Aug. 22, 2014, which is a continuation-in-part of U.S. patent application Ser. No. 13/470,499 filed on May 14, 2012, which is the non-provisional of U.S. Provisional Patent Application No. 61/485,298 filed on May 12, 2011 and also a continuation-in-part of U.S. patent application Ser. No. 12/974,287, filed on Dec. 21, 2010 (now U.S. Pat. No. 8,322,058). Copies of the above-referenced patent documents are incorporated herein by reference in their entirety.

FIELD OF THE INVENTION

The present invention is in the field of social expression and entertainment products, and more specifically to greeting cards with mechanical and electronic functions and features.

BACKGROUND OF THE INVENTION

Traditional paper greeting cards have been widely used for celebratory occasions such as birthdays, graduations, weddings, and for other commercial purposes. More recently, the market has expanded with greeting cards that attempt to capture attention by alternate designs and other features to enhance the communicative and entertainment value of social and relational greetings. The widespread availability of compact digital electronics has made incorporation into social communication products economical. Although the prior art includes greeting cards with sound-generating features, such cards are generally available only in a fixed format wherein a sound file is played upon activation by manipulation of the card. Cards with mechanical or structural features such as three-dimensional "pop-ups" are conventionally made with multiple panels or pages which are attached at various locations to unfold in multiple planes. A particular challenge to incorporate mechanical movement in a greeting card is to do so without making the card too bulky or thick, so that it has the same general configuration and size as conventional flat panel cards.

SUMMARY OF THE INVENTION

An interactive electronic greeting card with pop up feature includes a pocket or cavity which houses various electronic and mechanical components and a pop-up element. In a first position, the pop-up element is substantially contained within the greeting card pocket or cavity. In a second position, the pop-up element is substantially outside the greeting card pocket or cavity. A push button controls movement of the pop-up element between the first and second positions. Pressing the push button causes the pop-up element to be ejected or to "pop up" out of the greeting card pocket or cavity, revealing a greeting or other printed indicia. The push button also initiates playback of a preloaded digital audio file, which may be a spoken message, a sound, a song, music or other such audio recording. Manually pushing the pop-up element back into the cavity ends playback of the audio.

DETAILED DESCRIPTION OF PREFERRED AND ALTERNATE EMBODIMENTS

The greeting card of the present invention combines a spring loaded pop-up element and sound capability with a greeting card having some type of manual activation mechanism. The manual activation mechanism requires user interaction with the greeting card in order to reveal the pop-up element and to initiate playback of a pre-loaded digital sound file. The pop-up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity.

Figure 2:
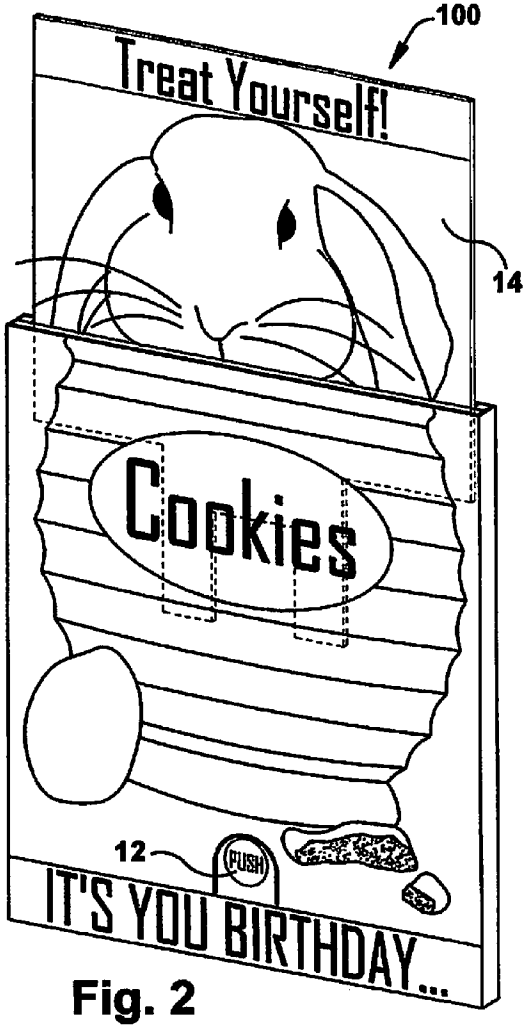
FIG. 2 is a perspective view of the Pop-Up Greeting Card of FIG. 1, in a second position.
Figure 1:
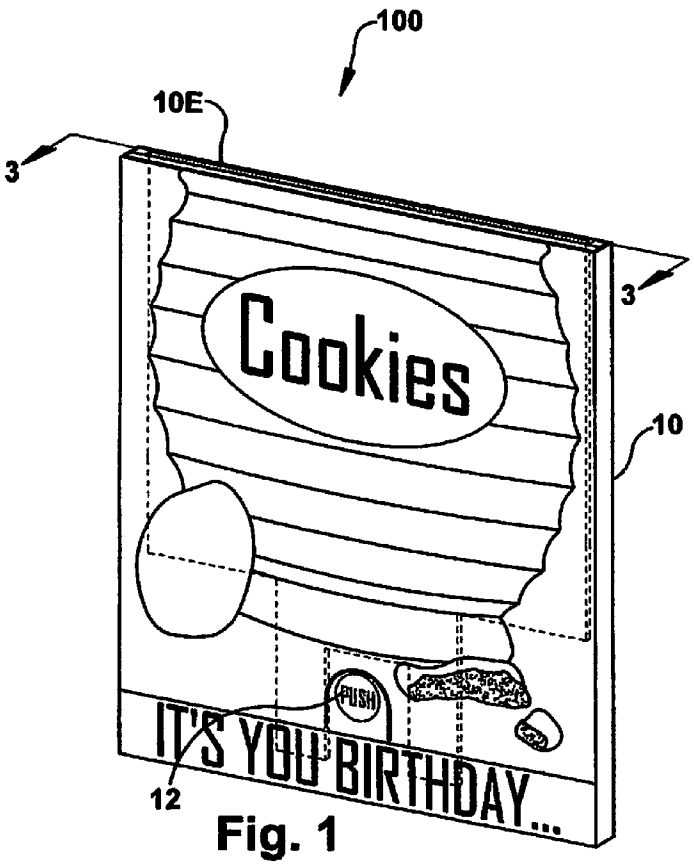
FIG. 1 is a perspective view of a first embodiment of the Pop-Up Greeting Card of the present invention, in a first position.
Figure 3:
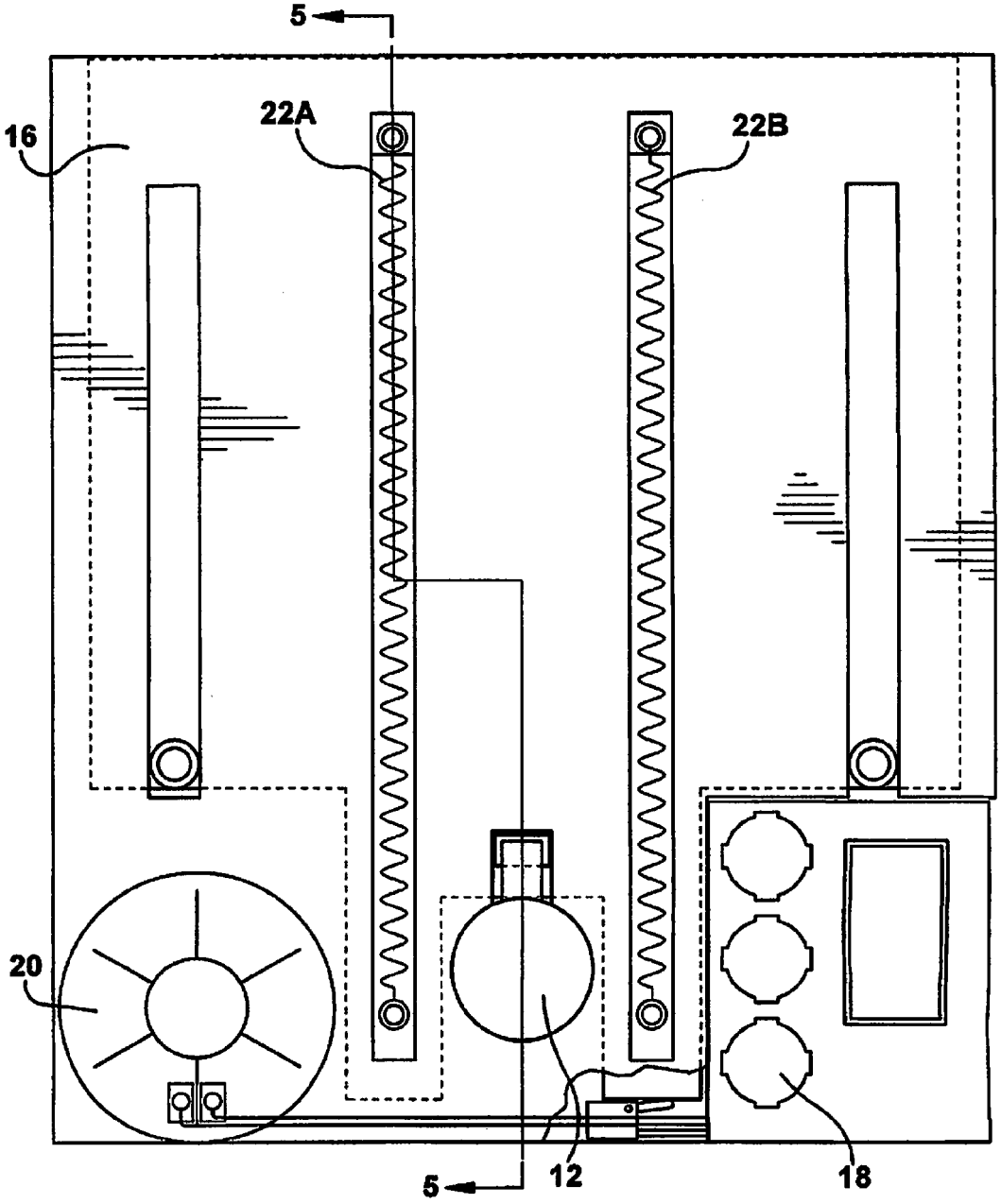
FIG. 3 is a front view of the internal components of the Pop-Up Greeting Card of FIG. 1.
Figure 4:
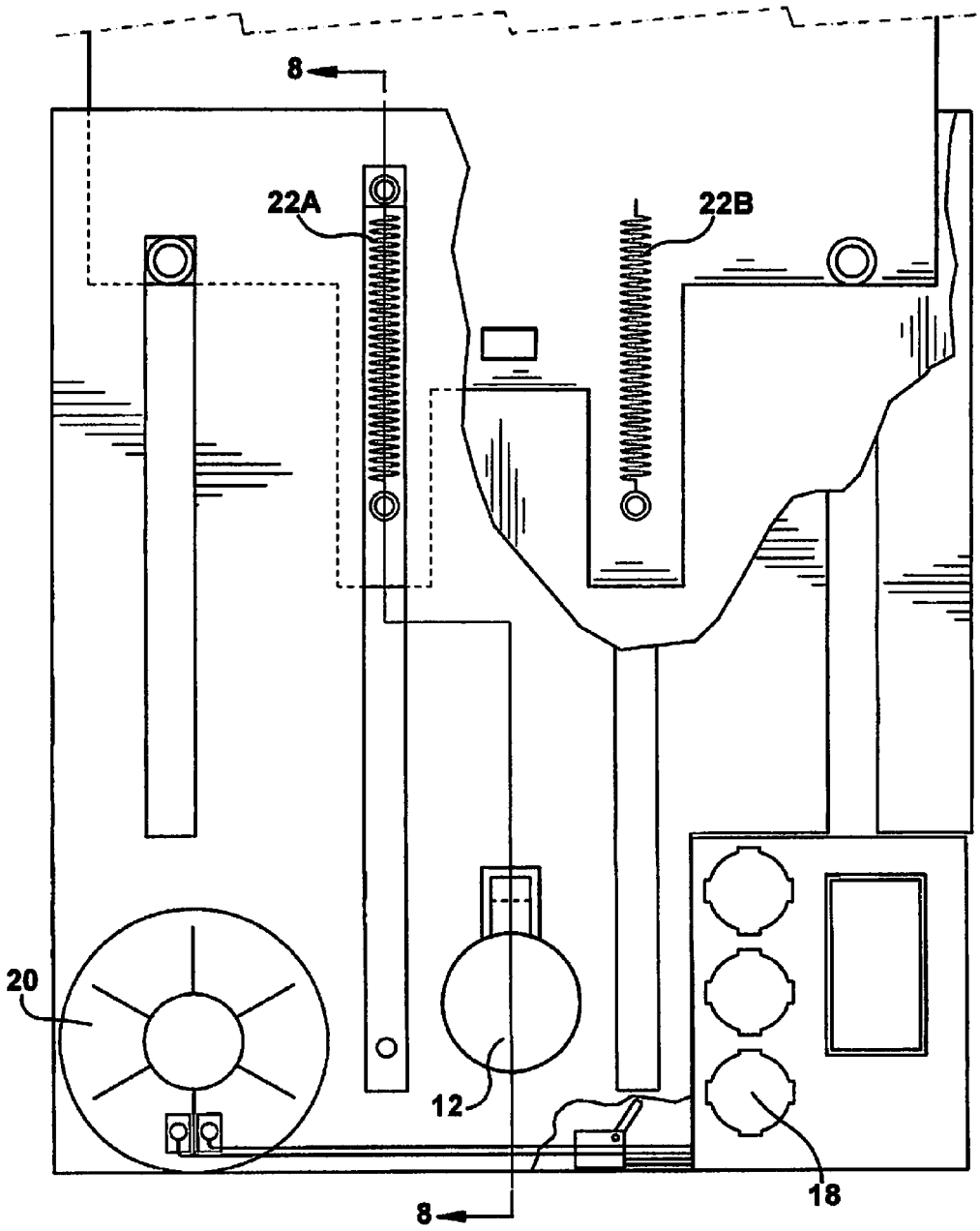
FIG. 4 is a front view of the internal components of the Pop-Up Greeting Card of FIG. 2.
Figure 5:
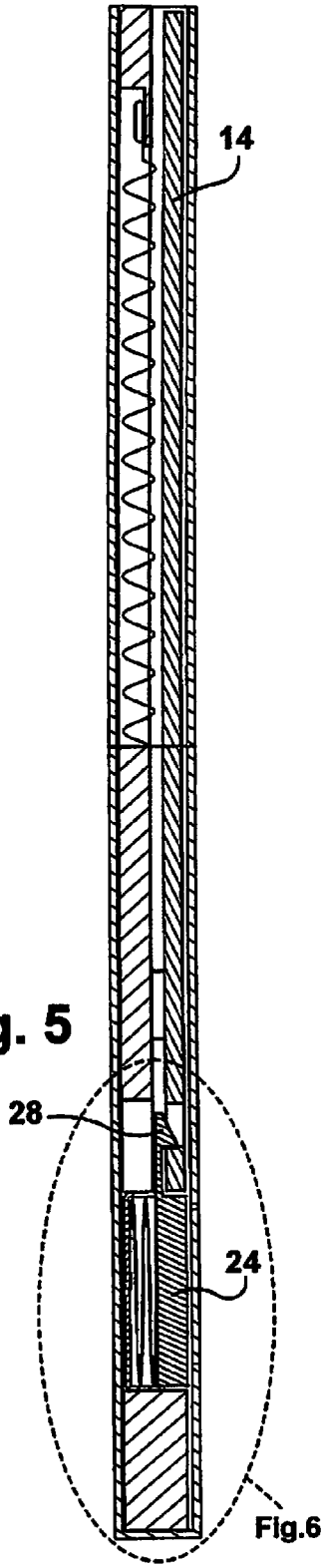
FIG. 5 is a cross-section of FIG. 3, viewed in the direction of arrows 5-5.
Figure 6:
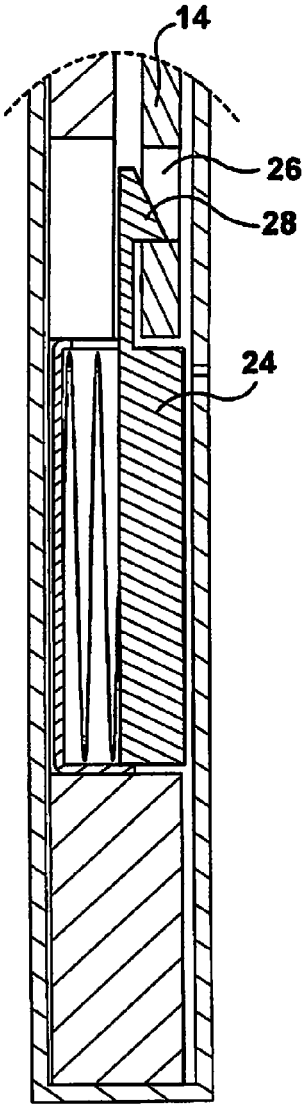
FIG. 6 is a close up view of a portion of FIG. 5.
Figure 7:
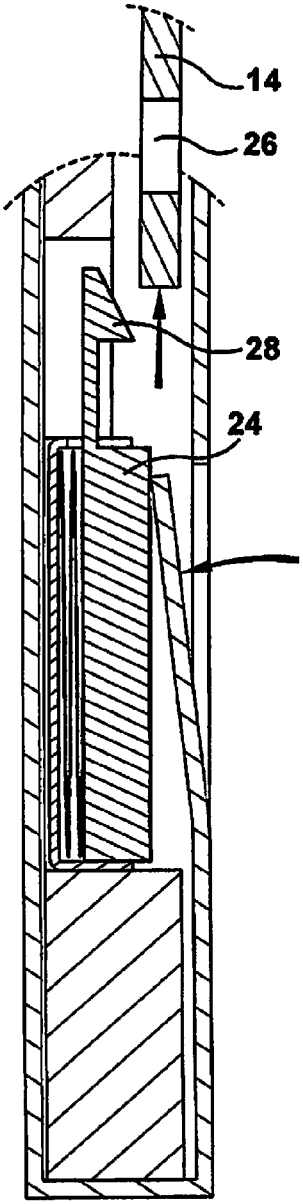
FIG. 7 is a close up view of a portion of FIG. 8.
Figure 8:
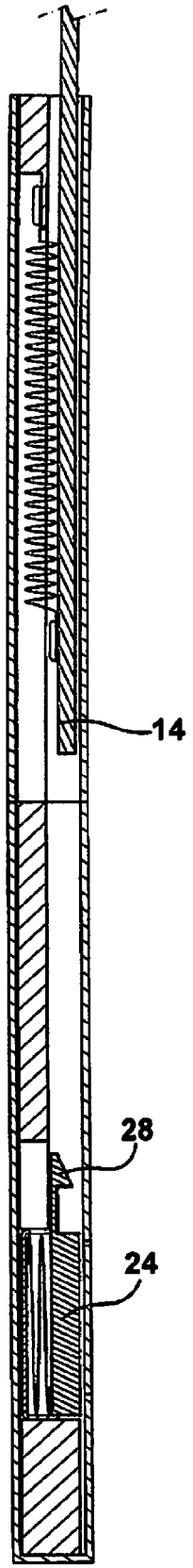
FIG. 8 is a cross-section of FIG. 4, viewed in the direction of arrows 8-8.

In one embodiment, shown in FIGS. 1 and 2, the greeting card body 10 has a front surface, a back surface parallel to and spaced apart from the front surface, and right, left and bottom side walls which extend between the front and back surfaces of the greeting card 100, creating a three sided pocket or cavity contained therein. A top edge 10E of the greeting card 100 is opened to accommodate the insertion and retraction of a pop-up element 14. The pocket or cavity is created by the three sided enclosure which, in a preferred embodiment is made of paperboard or other strong but lightweight material. Inside the pocket or cavity is contained a protective cardboard frame 16 for housing or accommodating electronic components, a push button 12 and spring activation mechanism or other activation mechanism, and a pop-up element 14. For example, the frame 16 can be made from one or more pieces of paperboard with appropriate cut-outs or openings which can be positioned between the front and back panels of the card to hold and secure the mechanical and electronic components of the card. The frame 16 contains a front panel and a back panel, both panels having various slots or openings strategically placed thereon to accommodate the various components of the greeting card 100. The front panel is parallel to and spaced apart from the back panel. In the space between the front and back panels are contained various components of the greeting card 100. In areas where no components are located, a piece of foam, cardboard, paperboard or other material may be used between the two panels to keep a consistent space between the panels. The electronic components may include a circuit board with integrated circuit and controller, memory storage device upon which at least one digital audio file is preloaded and saved, a power source, such as one or more batteries 18, a speaker 20, related circuitry and any other electronic component which may be required to store and replay one or more audio files, as are known to one with skill in the art. The pop-up element 14, in this particular embodiment, is a decorated panel having printed text, such as a birthday greeting and/or drawings or artwork contained thereon. The panel 14 is positioned between the front and back panels of the protective frame 16. The spring loaded mechanism includes two springs 22A, 22B which are attached at a first end to the bottom of the pop-up element or panel 14 and at a second end to an upper region of the protective frame 16. When the pop-up element 14 is in a first position substantially concealed within the greeting card, as shown in FIG. 1, the springs are stretched out, as shown in FIG. 3. A push button mechanism is contained between the protective panels 16 and contains a push button 12 that is connected to a catch or an arm 24. The catch or arm 24 of the push button mechanism contains a lip 28 that extends outward in a forward direction. The pop-up element or inner panel 14 contains a small opening 26 thereon so that when the pop up element 14 is in a first position substantially concealed within the greeting card 100, i.e., between the front and back panels of the card and within or proximate to the frame, the lip 28 of the catch or arm 24 extends into the opening 26 on the pop-up element or inner panel 14, thereby retaining the panel 14 within the greeting card 100 with the springs 22A, 22B in an extended or stretched position, as shown in FIGS. 3, 5 and 6. When the push button 12 is depressed it moves the catch or arm 24 causing the lip to become disengaged with the opening 26 on the pop-up element 14, releasing the springs 22A, 22B, as shown in FIGS. 4, 7 and 8. The mechanical energy stored in the springs 22A, 22B when they are in an extended or stretched state, propel or eject the pop-up element 14 upward through the opening along the upper edge 10E of the greeting card body 10. In addition to causing the pop-up element 14 to be revealed through the top of the greeting card 100, the press button 12 also initiates playback of the at least one preloaded audio file. The audio file may contain a spoken message, a song, music, various sounds, etc. When the pop-up element 14 is pushed back down and secured inside the greeting card 100, playback of the audio ends.

Figure 9:
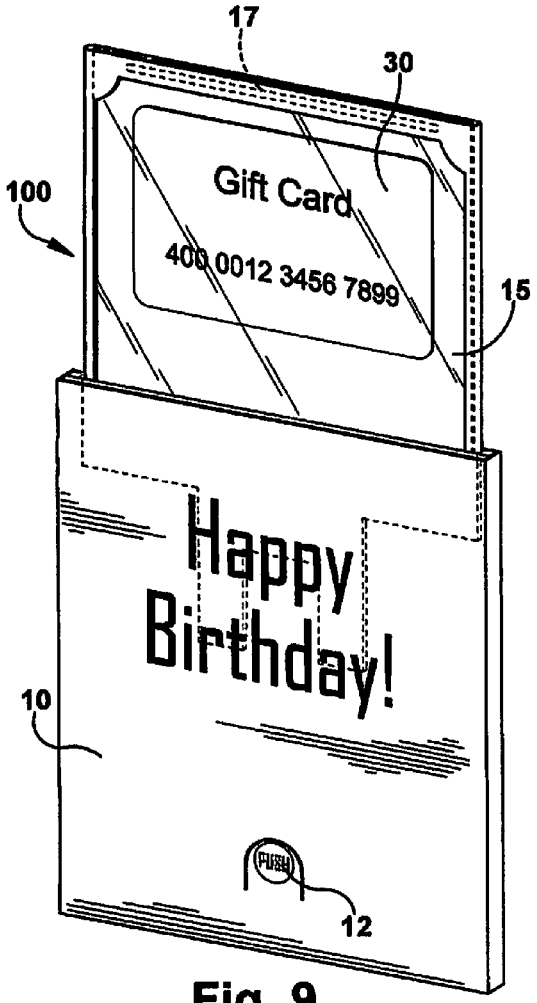
FIG. 9 is an alternate embodiment of the Pop-Up Greeting Card of the present invention.
Figure 11:
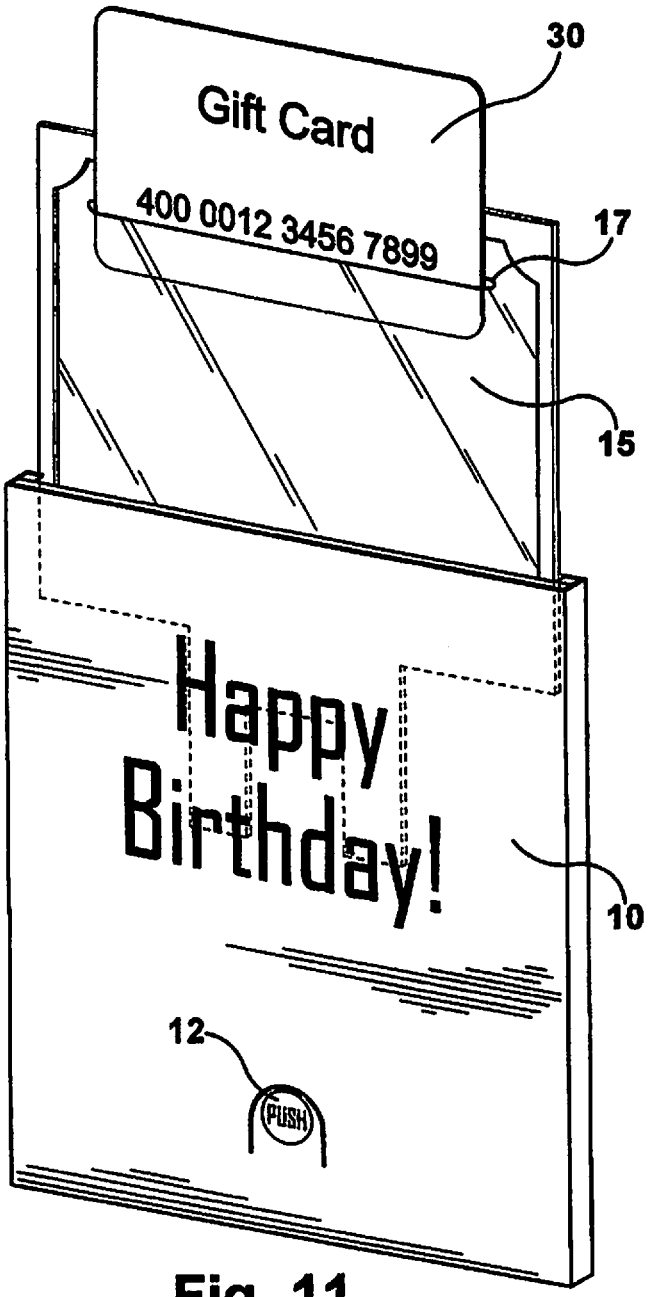
FIG. 11 is a perspective view of the Pop-Up Greeting Card of FIG. 9 with a gift card partially removed from a cavity.

In an alternate embodiment, shown in FIGS. 9 and 11, the greeting card of the present invention includes a pop-up element 15 which serves as a pocket or cavity wherein a gift card 30 may be inserted for presentation to the greeting card recipient. The greeting card body 10 may include, as described above, a main pocket or cavity which contains a front side, a back side which is parallel and spaced apart from the front side, and a right, back and bottom side which extend between the front and back panels along three side edges, thereby creating a three-sided pocket. The top of the greeting card is open for inserting the pop-up element 15. The pop-up element 15 is in itself another pocket or cavity which is operative to contain a standard sized gift card 30. The pop-up cavity 15 may contain a front surface which contains an opening thereon through which the gift card 30 is visible, or the pop-up cavity 15 may contain a front surface which contains an opening thereon which is covered with acetate or other clear, transparent material, through which the gift card 30 is visible. The acetate may contain an opening thereon to facilitate removal of the gift card therefrom. Alternatively, the entire pop-up cavity 15 may be made of acetate or other clear, transparent material. The pop-up cavity 15 may be closed on all sides to prevent accidental removal of the gift card, with a slot 17 or flap or tab removably attached along a top surface which can be used to open the cavity 15 and remove the gift card 30. The cavity 15 may also be a three-sided cavity with a completely open top edge for removal of the gift card 30. The pop-up cavity 15 is larger than the measurements of a standard gift card, which are approximately 5¼ inches high and 3⅝ inches wide. Alternatively, the pop-up element may be a single panel, as described above, with a gift card 30 removably attached thereto. The spring and push button mechanism described above, may be used to move the pop-up cavity 15 (with gift card 30 therein) between a first position wherein the pop-up cavity 15 is substantially concealed within the main greeting card pocket or cavity and a second position wherein the pop-up cavity 15 is substantially outside of the main greeting card pocket or cavity. The protective frame construct, also described above, may also be used in this embodiment to protect the various inner components of the greeting card 100. This embodiment may also include a sound module contained within the main pocket or cavity which is operative to store and playback at least one pre-recorded audio file.

Figure 10:
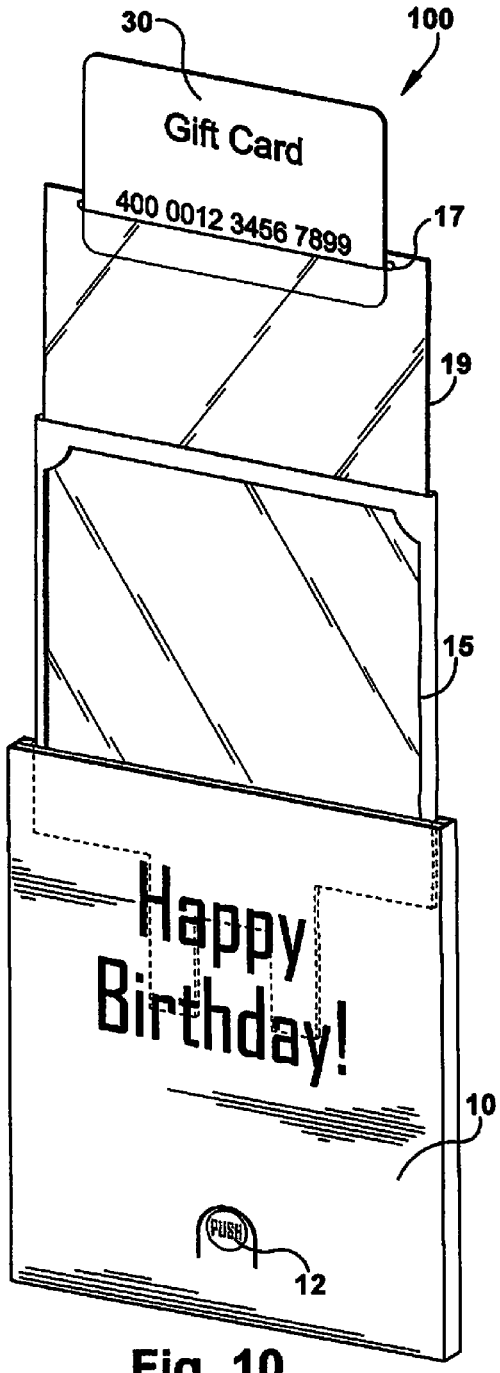
FIG. 10 is an alternate embodiment of the Pop-Up Greeting Card of the present invention.

In still another embodiment, shown in FIG. 10 the greeting card 100 includes two or more telescoping pockets or panels 19 which telescope in an inward and outward direction with respect to one another. The smallest or innermost pocket may contain a gift card 30 therein or removably attached thereto. Alternately, the gift card 30 may be configured to fit within the smallest or innermost pocket 19 and it may be ejected from said pocket 19 upon pushing the press button 12. The first or main pocket or cavity 10 serves as the outer surface of the greeting card 100, as described above with reference to the other embodiments, and therefore is the largest of the pockets or panels of the greeting card 100. All of the other pockets or cavities 19 of the greeting card 100 are sized to fit within the first or main pocket 10 of the greeting card 100. After the first or main pocket 10, each successive pocket or cavity 19 is slightly smaller in size than the previous pocket or cavity such that each successive pocket or cavity 19 fits within the previous pocket. The main pocket or cavity 10, as described above, may have a front side, a back side parallel to and spaced apart from the front side and right, left and bottom sides which extend between the front and back panels along three side edges of the main panel or cavity. The spring and push button mechanism described above with respect to the other embodiments can be used to move the two or more inner pockets or cavities from a first position wherein the inner pockets or cavities are substantially contained and concealed within the main pocket or cavity and a second position, wherein the two or more inner pockets or cavities are substantially outside of the main pocket or cavity. The protective frame described above may also be used with this embodiment to protect the various internal components of the greeting card. This embodiment may also contain a sound module, as described above, which is operative to replay a pre-recorded audio file upon pressing the press button. Alternatively, instead of a gift card, the pocket or pockets may contain a smaller greeting card, small token gift or other novelty which can be fit within one or more of the inner pockets.

In yet another embodiment, shown in FIGS. 12-16, the greeting card described herein combines a spring loaded pop-up element which contains confetti which is ejected or dispersed when the user activates a switch mechanism, which in a preferred embodiment, is a press button switch. The switch may also activate sound simultaneously with ejecting the confetti. The pop up element is retained inside a pocket or cavity of the greeting card and a spring loaded mechanism controls the movement of the pop-up element between a first position concealed within a pocket or cavity of the greeting card and a second position wherein a significant portion of the pop-up element is ejected from the pocket or cavity while scattering confetti around the area of the greeting card.

Figure 12:
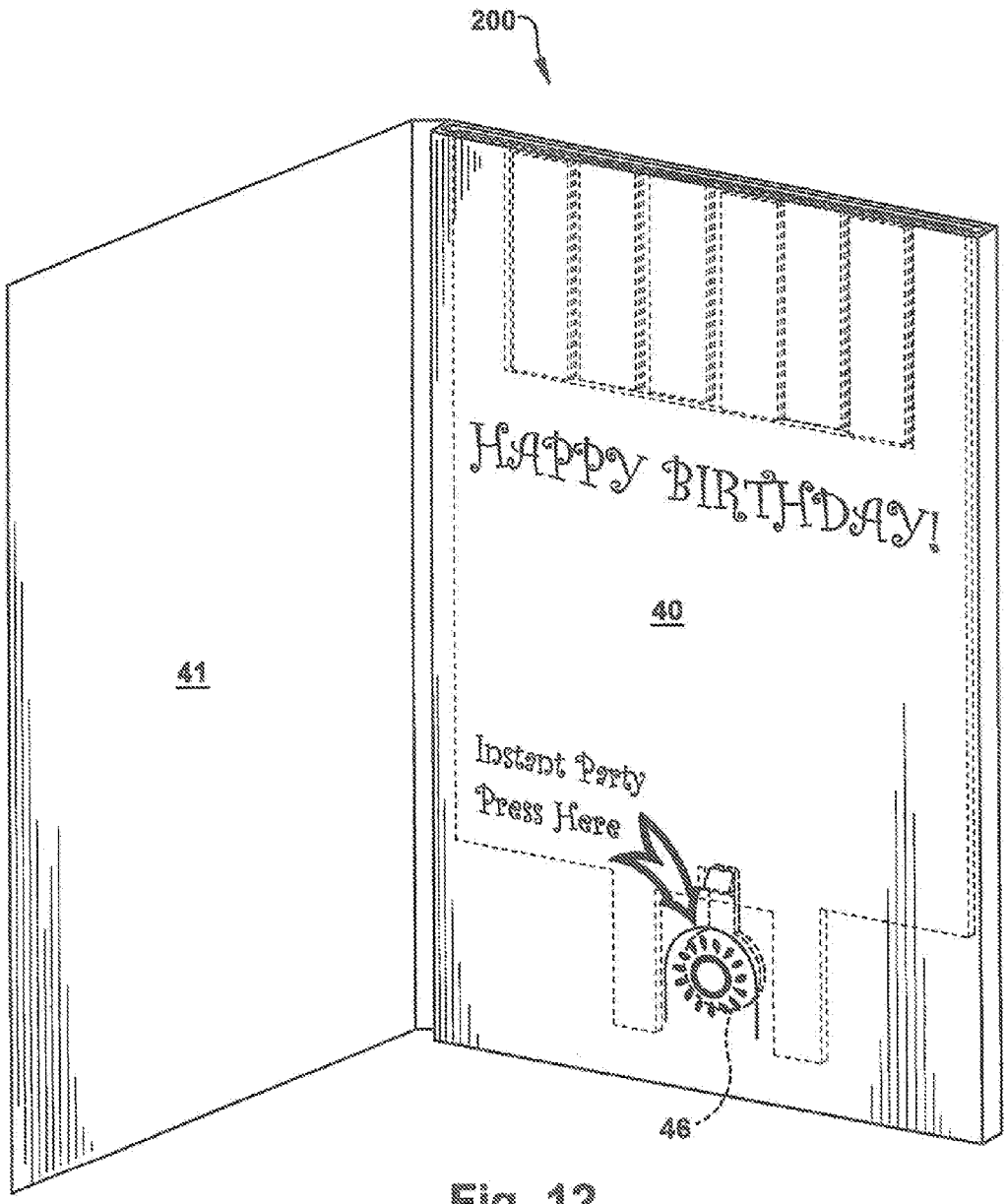
FIG. 12 is a perspective view of an alternate embodiment of the Pop-Up Greeting Card of the present invention.
Figure 13:
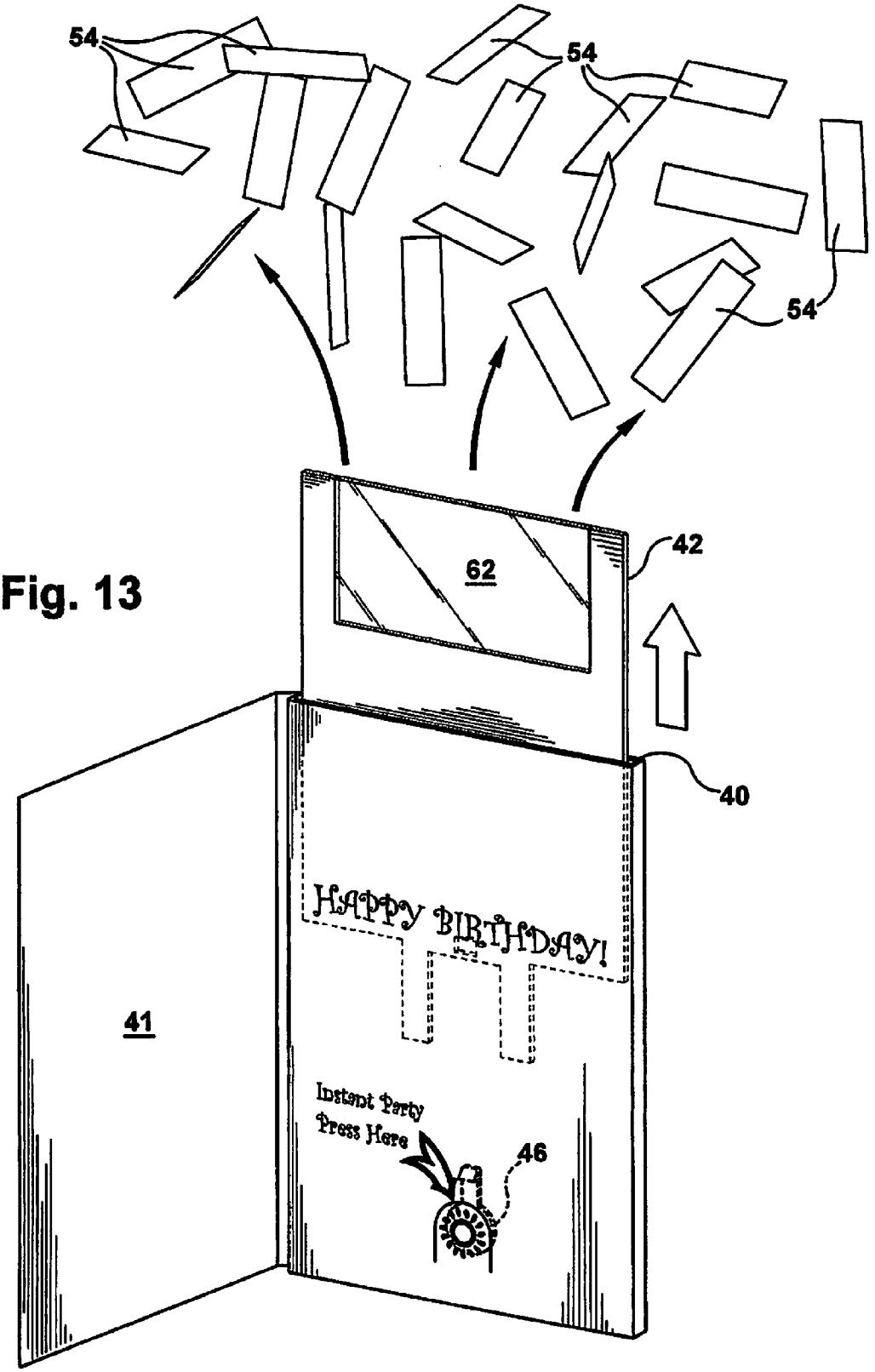
FIG. 13 is a perspective view of the Pop-Up Greeting Card of FIG. 12, with ejected panel and confetti.

In this embodiment, the greeting card body contains a pocket 40 which has a front surface, a back surface parallel to and spaced apart from the front surface, and a right, left and bottom side wall which extend between the front and back surfaces of the greeting card, creating the three sided pocket or cavity. A top edge of the pocket 40 is opened to accommodate the insertion and retraction of a pop-up, confetti-retaining element 42. The pocket or cavity 40, in a preferred embodiment, is made of paperboard or other strong but lightweight material. Inside the pocket or cavity 40 is contained a protective cardboard frame for housing 44 or accommodating electronic components, a push button 46 and spring activation mechanism or other activation mechanism, and a pop-up element 42. For example, the frame 44 can be made from one or more pieces of paperboard with appropriate cut-outs or openings can be positioned between the front and back panels of the pocket 40 to hold and secure the mechanical and electronic components of the card. The frame 44 various slots or openings strategically placed thereon to accommodate the various components of the greeting card. In areas where no components are located, a piece of foam, cardboard, paperboard or other material may be used to keep a consistent space between the front and back panels of the frame 44. The pocket 40 may be wrapped, at least partially, by paperboard (or other material) cover 41 which is divided into panels sectioned by fold lines. The paperboard cover 41 extends over the back surface, left side wall and front surface of the pocket 40. The cover 41 may be attached, adhesively or otherwise, to the back surface of the pocket 40. The portion of the cover 41 which extends over the left side wall and the front surface of the pocket 40 is not physically attached to the pocket 40 but merely wraps around the pocket to serve as the front cover and left inside panel of the greeting card 200, as shown in FIG. 12. Alternately, the portion of the cover 41 which extends over the left side wall of the pocket 40 may be attached thereto, adhesively, or otherwise.

The electronic components of the greeting card may include a circuit board 48 with integrated circuit and controller, memory storage device upon which at least one digital audio file is pre-loaded and saved, a power source 50, such as one or more batteries, a speaker 52, related circuitry and any other electronic component which may be required to store and replay one or more audio files, as are known to one with skill in the art.

Figure 14:
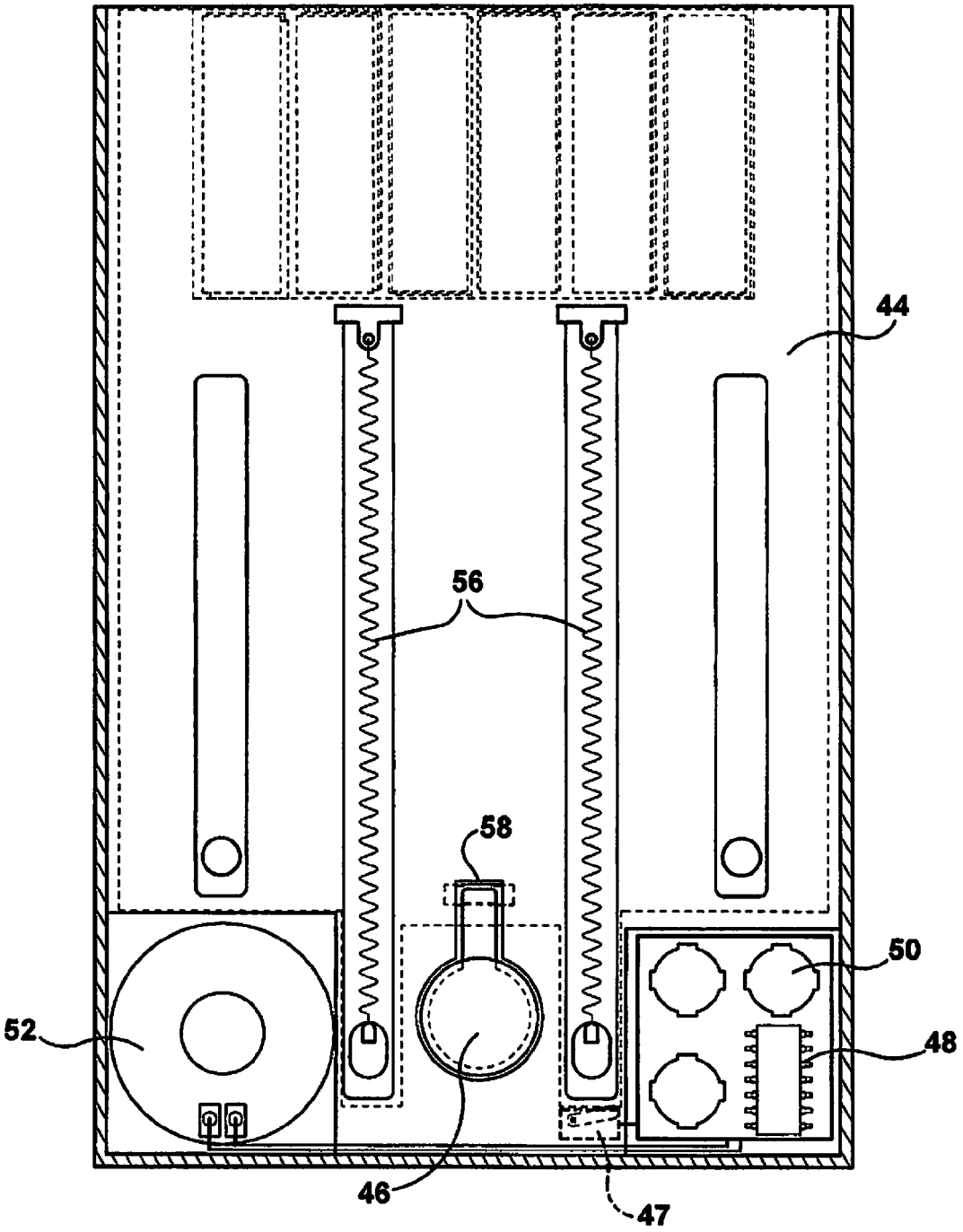
FIG. 14 is a front view of the internal components of the Pop-Up Greeting Card of FIG. 12.
Figure 15:
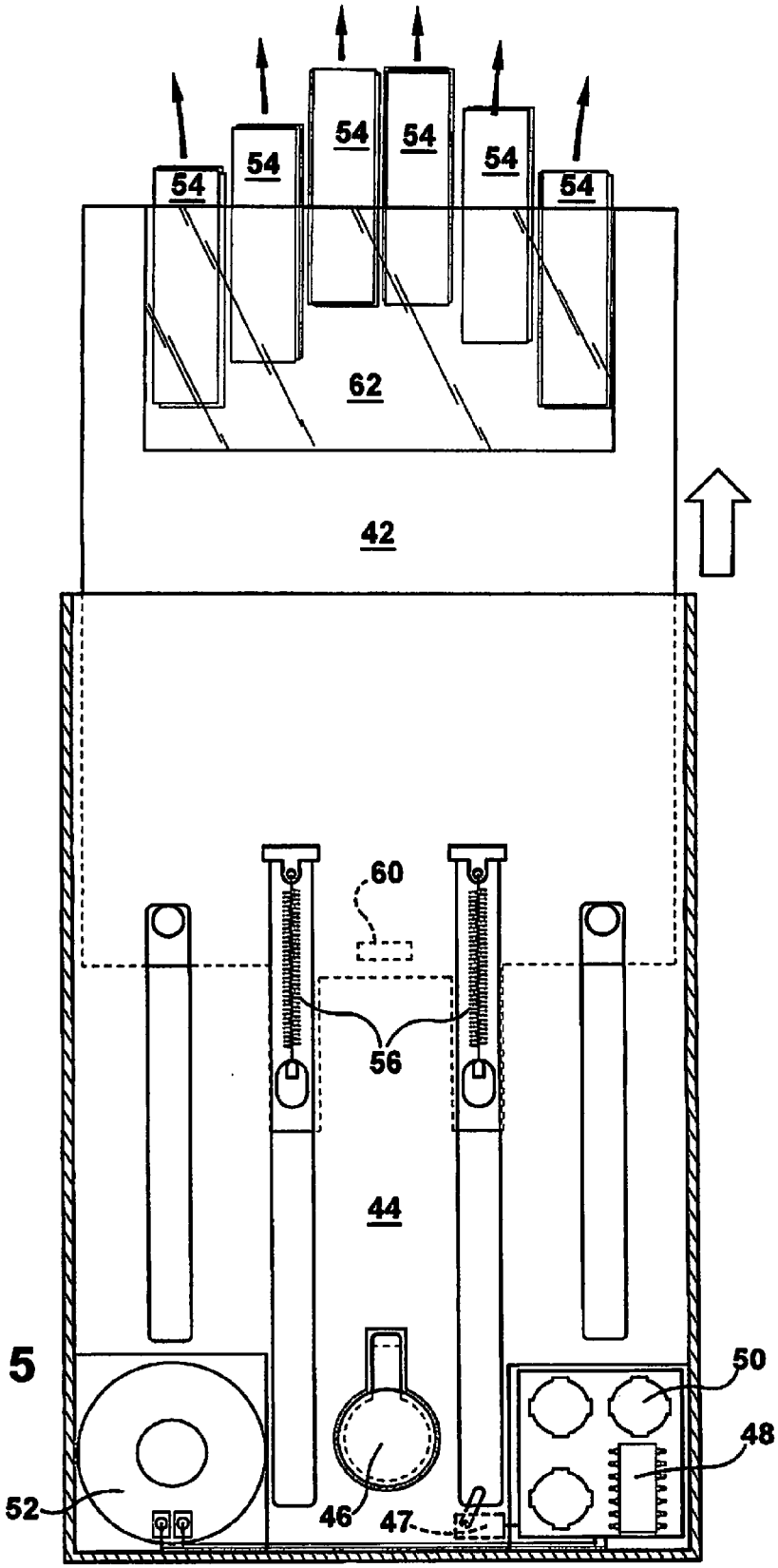
FIG. 15 is a front view of the internal components of the Pop-Up Greeting Card of FIG. 12, with ejected panel and confetti.
Figure 16:
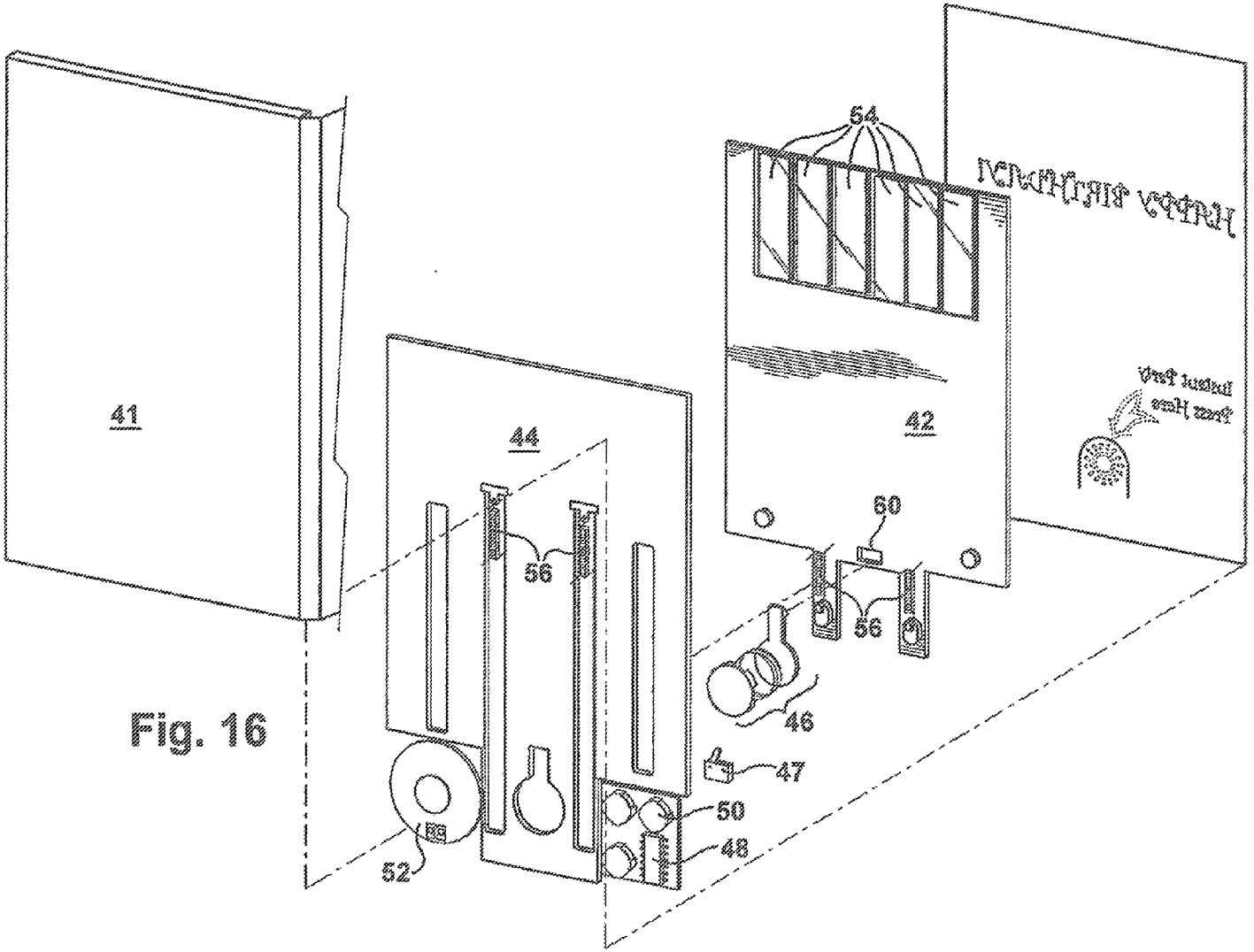
FIG. 16 is an exploded view of the Pop-Up Greeting Card of FIG. 12.
Figure 17:
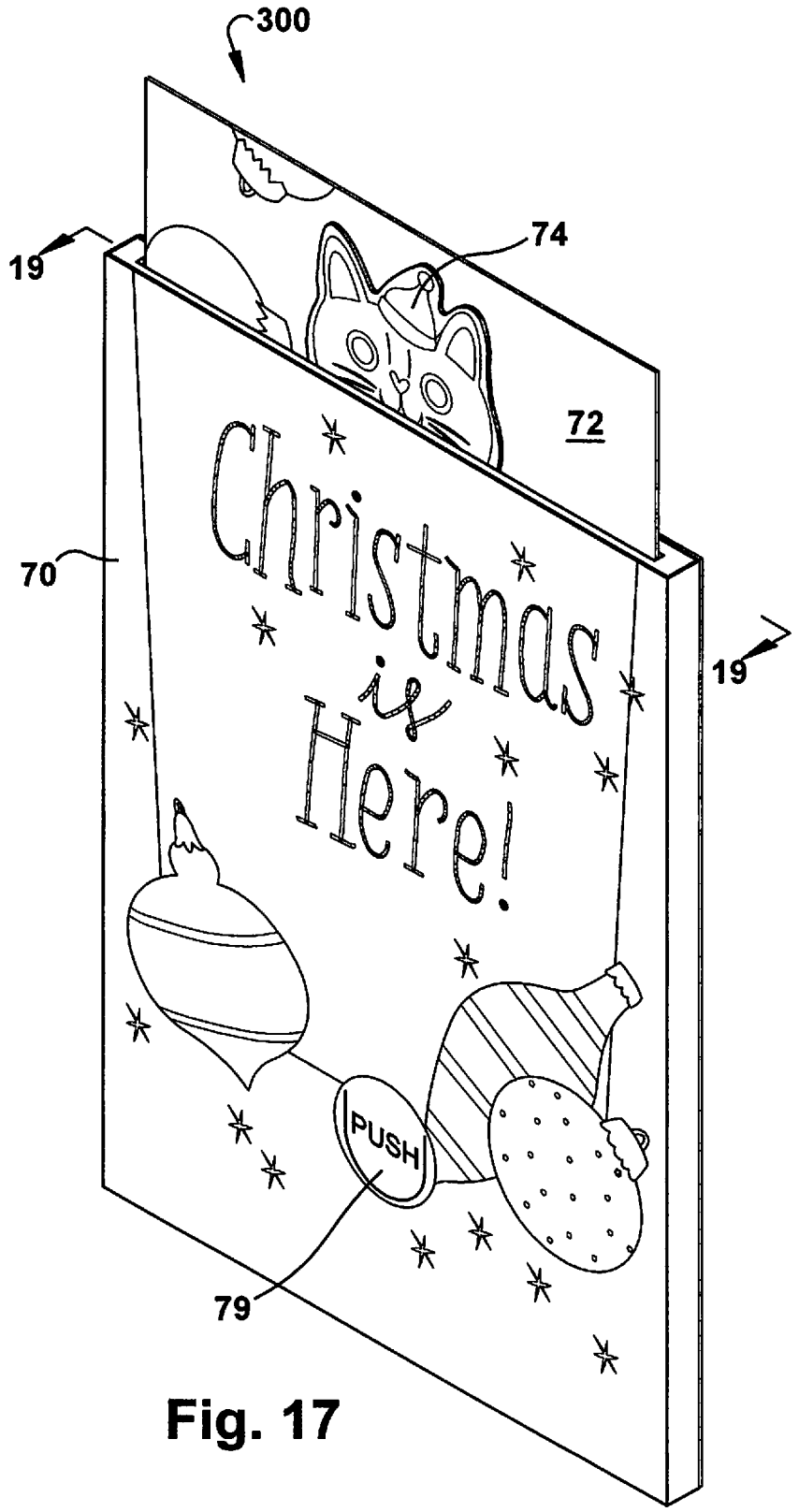
FIG. 17 is a perspective view of an alternate embodiment of the Pop-Up Greeting Card of the present invention.

The pop-up element 42, in this particular embodiment, is a narrow cavity or compartment having a front panel and a back panel which contain the confetti 54 therebetween. The front and back panels of the pop-up element 42 may have printed text, such as a birthday greeting and/or drawings or artwork contained thereon. The pop-up element 42 is positioned between the front and back panels of the protective frame 44. The spring loaded mechanism includes two springs 56 which are attached at a first end to the bottom of the pop-up element 42 and at a second end to an upper region of the protective frame 44. When the pop-up element 42 is in a first position substantially concealed within the greeting card, the springs are compressed or stretched. A push button mechanism is contained between the protective panels 44 and contains a push button 46 that is connected to a catch or an arm 58. Words may be printed on the greeting card directing the user to the push button 46. For example, the printing may say something like "instant party, press here". The catch or arm 58 of the push button mechanism 46 contains a lip that extends outward in a forward direction. The pop-up element or inner compartment 42 contains a small opening thereon 60 so that when the pop up element 42 is in a first position substantially concealed within the greeting card, i.e., between the front and back panels of the pocket 40 and within or proximate to the frame 44, the lip of the catch or arm 58 extends into the opening 60 on the pop-up element 42, thereby retaining the pop-up element 42 within the pocket 40 with the springs 56 in an extended position, as shown in FIG. 14. When the push button 46 is depressed it moves the catch or arm 58 causing the lip to become disengaged with the opening 60 on the pop-up element 42 and releasing the extended or stretched springs 56. The mechanical energy stored in the springs 56 when they are in a stretched state, propel or eject the pop-up element 42 upward through the opening along the upper edge of the pocket 40 while releasing the confetti 54. The confetti 54 may be a plurality of strands or bits of paper, small die cut shapes, or any other small, flat, lightweight, paper-like substance. The term confetti also covers streamers, paper discs, spiders, or any other small lightweight item that can be dispersed from the pop-up element 42. The confetti 54 is ejected along with the inner compartment 42 which houses the confetti 54 and then floats to the ground. Prior to purchasing the greeting card at retail, the inner compartment 42 which contains the confetti 54 may have an overlying transparent plastic sheet or wrapping 62 to allow consumers to test the card at retail by pressing the button 46 and having the pop-up element or inner compartment 42 appear. A sticker or other mild adhesive may be used to attach the transparent plastic sheet or cover 62 to the pop-up element 42. Once a consumer purchases the card, he/she may remove the sticker and the plastic sheet 62 before placing the card 200 in the envelope for presentation to the recipient. In addition to causing the pop-up element 42 to be revealed through the top of the greeting card 200 and releasing the confetti 54, the press button 46 also initiates playback of the at least one pre-loaded audio file. The audio is triggered by a small trigger mechanism 47, which contains a lever that is held in place by one of the spring elements 56. The lever pivots about the trigger mechanism 47. When the pop-up-element 42 (to which the spring mechanism 56 is attached) is in the first position, wherein it is contained within the pocket 40, the spring element 56 holds the lever on the trigger mechanism 47 in a first position, as shown in FIG. 14. When the press button 46 is depressed, moving the pop-up element 42 from the first position to a second position, wherein the pop-up element 42 is substantially outside of the pocket 40, the lever is released, allowing it pivot away from the trigger mechanism 47 (as shown in FIG. 15) and allowing the circuit to be completed, thereby initiating playback of at least one audio file. The audio file may contain a spoken message, a song, music, various sounds, etc. When the pop-up element 42 is pushed back down and secured inside the pocket 40, playback of the audio ends. The next time the push button 46 is depressed, the pop-up element 42 will still be ejected from the greeting card 200 but without the confetti 54 that was used on the first push of the button. In another embodiment, the greeting card may be packaged with additional confetti that may be paced by hand inside the greeting card or the envelope.

In still another embodiment, the greeting card of the present invention combines the embodiments shown in FIGS. 9-11 with the embodiment shown in FIGS. 12-16. The pop-up element contains a pocket, as described above with respect to FIGS. 9 and 11, or two or more telescoping pockets or panels, as described above with respect to FIG. 10. The pop-up element also contains confetti, as described above with respect to FIGS. 12-16. This embodiment provides the surprise of the pop-up element and confetti while serving as a carrier or gift card holder. In one embodiment, the gift card is contained within one of the pockets, as described above, or the gift card may be removably attached to the front surface of the pop-up panel while the confetti is dispersed from the inside of the pop-up panel, as described above. In another embodiment, the gift card may be removably attached to the greeting card body, instead of the pop-up panel or cavity.

In still another embodiment, the greeting card of the present invention may include a pop-up element between two panels of the greeting card. Instead of having a large pocket or cavity into which another cavity or pocket (with or without confetti) is inserted, the greeting card may be contain a three-dimensional pop-up element which is contained between two panels of the greeting card. The three-dimensional pop-up element may be moveable between a first position, wherein the pop-up element is folded into a substantially flat, folded configuration between two greeting card panels and a second position, wherein the pop-up element is unfolded into a three-dimensional pop-up structure. The pop-up structure moves between the first and second positions by closing (first position) and opening (second position) the greeting card. Confetti, as described above, can be contained within the three-dimensional pop-up element such that when the greeting card is moved to an open position wherein the pop-up element is unfolded, confetti is released through an opening in the three-dimensional pop-up structure. A retaining mechanism may be contained within the pop-up structure which stores the confetti and releases the confetti upon opening the greeting card. The three-dimensional pop-up structure may be formed into a structure which complements the theme and/or artwork of the greeting card. The confetti contained therein may also take on a particular size, shape and color which is complementary to the overall theme of the greeting card. For example, the pop up structure may be shaped like a box of popcorn, and when the greeting card is opened and the popcorn box is unfolded, confetti is released from within the structure which resembles popcorn. Another example may have the pop-up structure as a can and the confetti shaped like snakes or a pop-up structure as a tornado with confetti shaped like sharks. The pop-up structure and confetti can take on a variety of different shapes, sizes and may be made from a variety of materials. The confetti-releasing mechanism may be operative to release the confetti upon opening the greeting card, as described above, or it may have alternative trigger methods such as a pull string, push button, light sensor, touch sensor, magnetic trigger, or any other such mechanism. The pop-up structure may only release confetti upon the first opening of the greeting card or it may have an opening thereon, through which additional confetti may be inserted for release upon subsequent openings of the greeting card. The confetti release mechanism may also contain a lock mechanism which prevents the release of confetti upon opening the greeting card until the lock mechanism has been opened or released. This prevents the release of confetti upon opening the greeting card at retail prior to purchase or upon opening the greeting card prior to presentation to the greeting card recipient. In addition to releasing confetti, this embodiment may also contain a small pocket or cavity which contains a gift card or other item, as described above with regard to the other embodiments. The pocket or cavity may be ejected or pushed upward from the top of the pop-up structure so the pocket or cavity is visible to the greeting card recipient. As described above with respect to the other embodiments, the pocket or cavity may be transparent so the existence of the gift card therein is immediately recognized. The pocket or cavity may have an opening thereon through which the gift card (or other object) can be inserted and removed. The gift card may be packaged and sold together with the greeting card or the greeting card may be sold with an empty pocket or cavity so that the gift card purchaser can select and purchase a gift card of his/her choice to place within the pocket or cavity of the greeting card.

In another embodiment of the greeting card of the present invention, shown in FIGS. 17-22, the greeting card contains a pop-up panel, as described in the embodiments described above, and shown in FIGS. 1-8, but also contains a mobile element attached to the pop-up panel that is attached to a motor for effecting movement of the mobile element.

Figure 18:
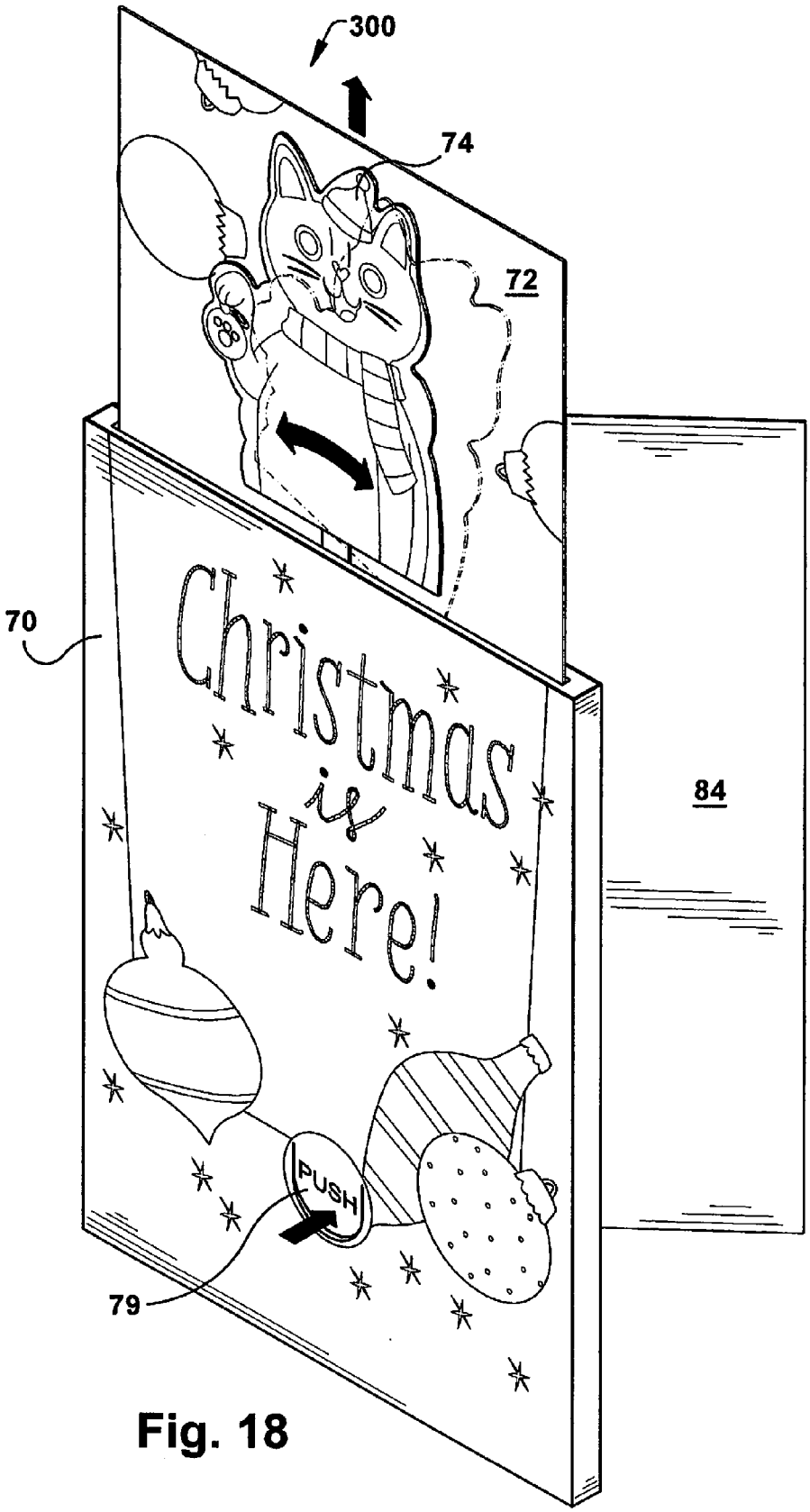
FIG. 18 is a perspective view of the greeting card of FIG. 17, in an open position with visible pop-up panel.

As described above with respect to the embodiment shown in FIGS. 1-8, the greeting card body has a front surface, a back surface parallel to and spaced apart from the front surface, and right, left and bottom side walls which extend between the front and back surfaces of the greeting card, creating a three-sided pocket or cavity 72 therein. A top edge of the pocket or cavity 70 is open to accommodate the insertion and retraction of a pop-up panel 72. The pocket or cavity 70, in a preferred embodiment, is made of paperboard, cardboard, although other various materials may be used. A protective frame 76 is contained inside the pocket or cavity 70, for retaining and protecting electronic components of the greeting card 300, a switch or trigger, an activation mechanism, and a pop-up panel 72 and moving element 74. The protective frame 76 can be made from one or more pieces of cardboard or other material having various cut-outs or openings thereon to secure and protect the various internal components of the greeting card 300, as mentioned above. In certain areas where there are no internal components, a piece of foam, cardboard, or other material may be inserted therein to keep a consistent space within the cavity or pocket 70. The electronic components of the greeting card may include, but are not limited to: a circuit board 71 with integrated circuit ship and controller, a memory storage device upon which a least one audio file is saved, a power source 73, such as one or more batteries, a speaker 75, a motor 77, related circuitry and any other electronic component which may be required or which may help facilitate audio playback through the speaker, motor movement of a mobile element or any other special effects, such as lights, etc., which are known to one having skill in the art. The pop-up panel 72, in this embodiment, is similar to the pop-up panel described above with respect to the other embodiments, having a substantially planar front and back surface and being appropriately stiff or rigid. The pop-up panel 72 may have text, drawings, artwork or other indicia printed thereon. The panel 72 is positioned between and parallel to the front and back panels of the cavity or pocket 70. An optional sentiment panel 84, as shown in FIG. 18, may be attached to the back edge of the greeting card 300 and which may be folded away from the pocket or cavity 70 (like a traditional greeting card) to reveal a message, greeting, drawing, picture, photo, or other printed indicia.

Figure 19:
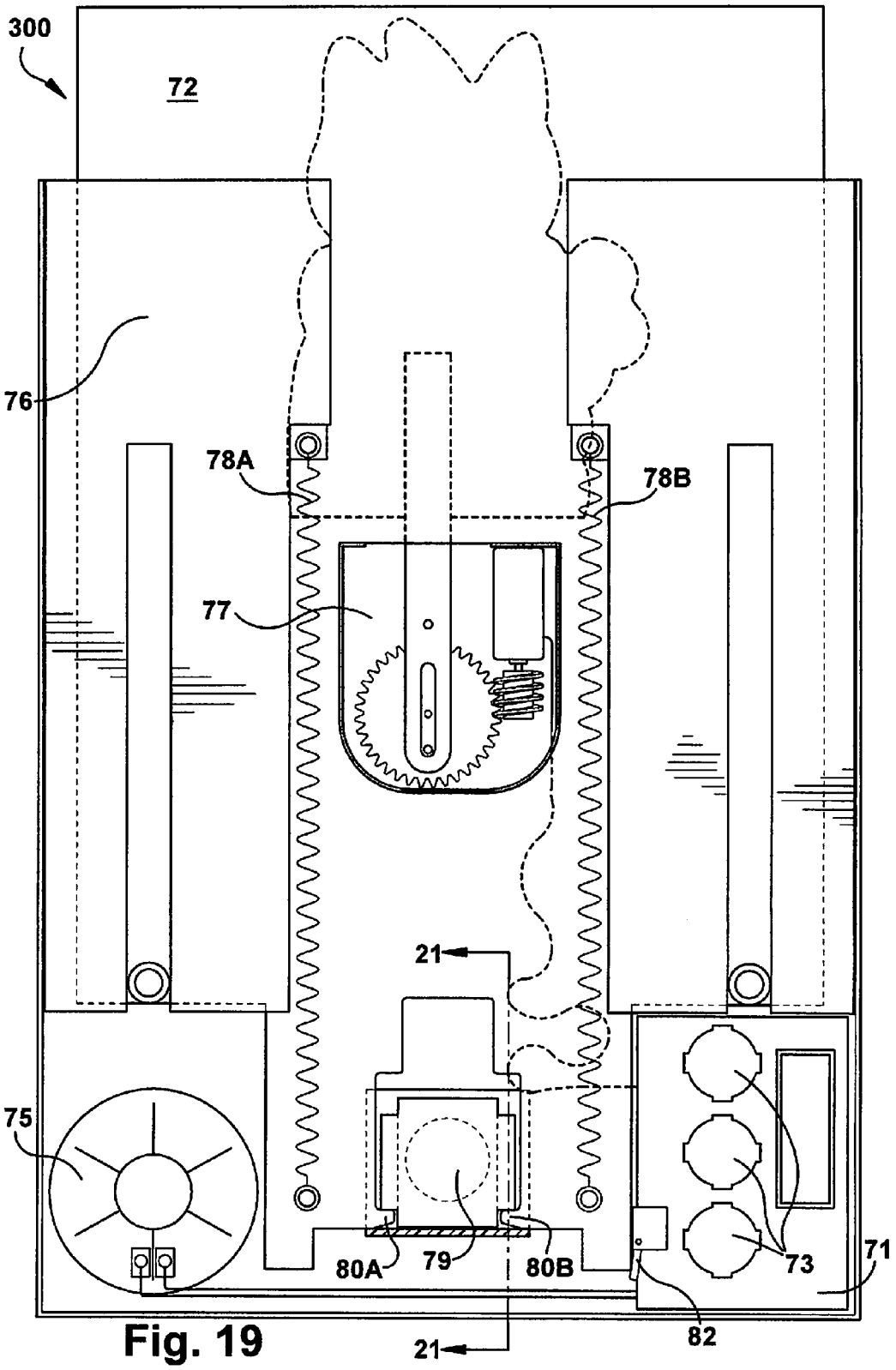
FIG. 19 is a cross-sectional view of the greeting card of FIG. 17, from the perspective of arrows 19-19, with the pop-up panel substantially contained within the pocket.
Figure 20:
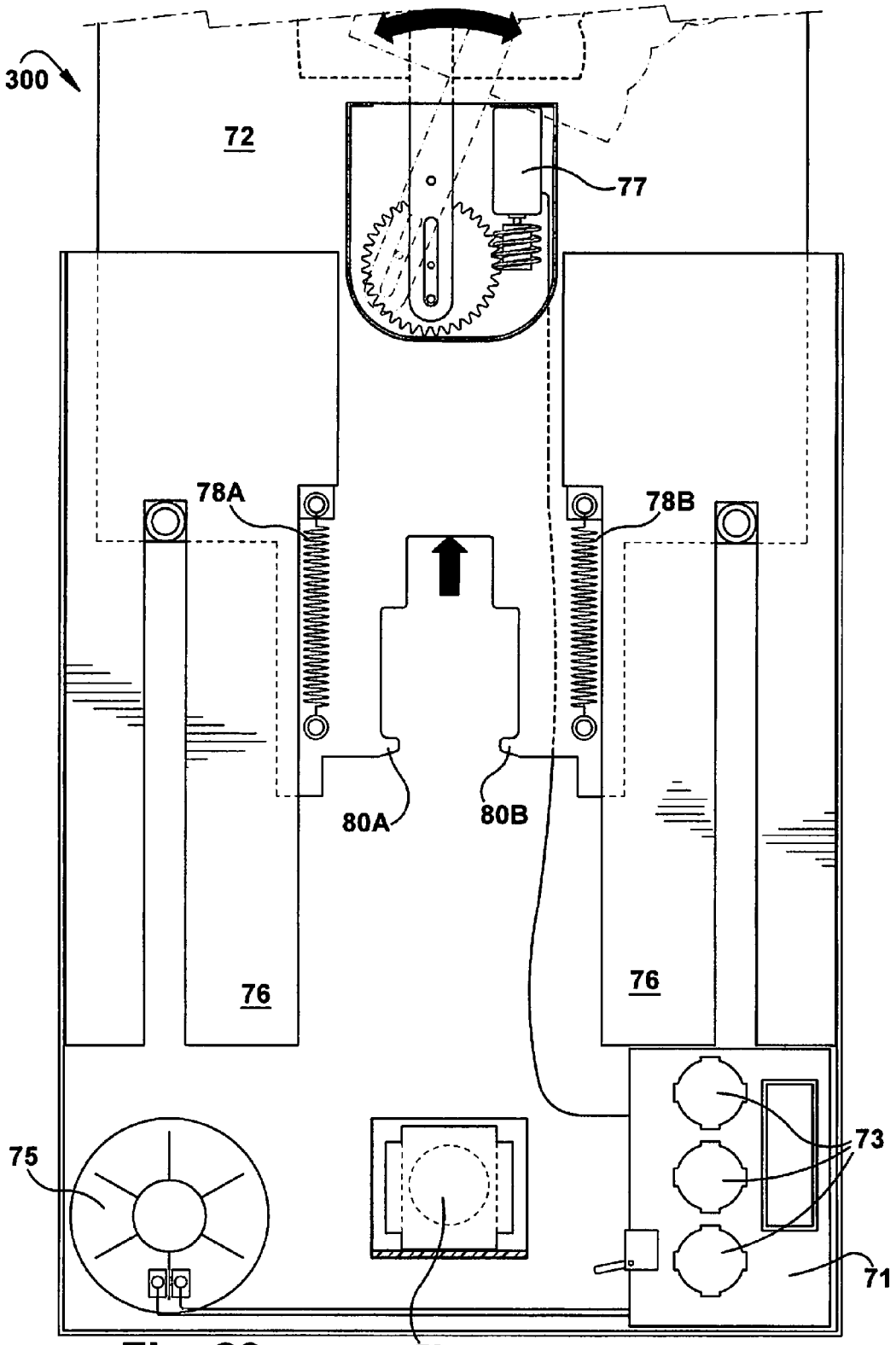
FIG. 20 is a cross-sectional view of the greeting card of FIG. 17, with the pop-up panel substantially contained outside of the pocket.
Figure 21:
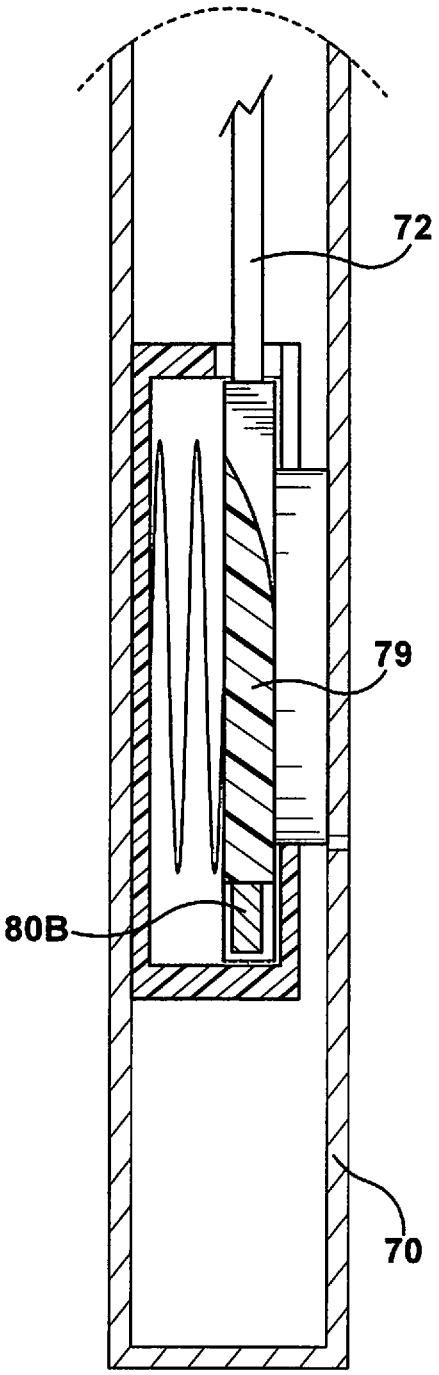
FIG. 21 is a partial cross-sectional view of FIG. 19, from the perspective of arrows 21-21.
Figure 22:
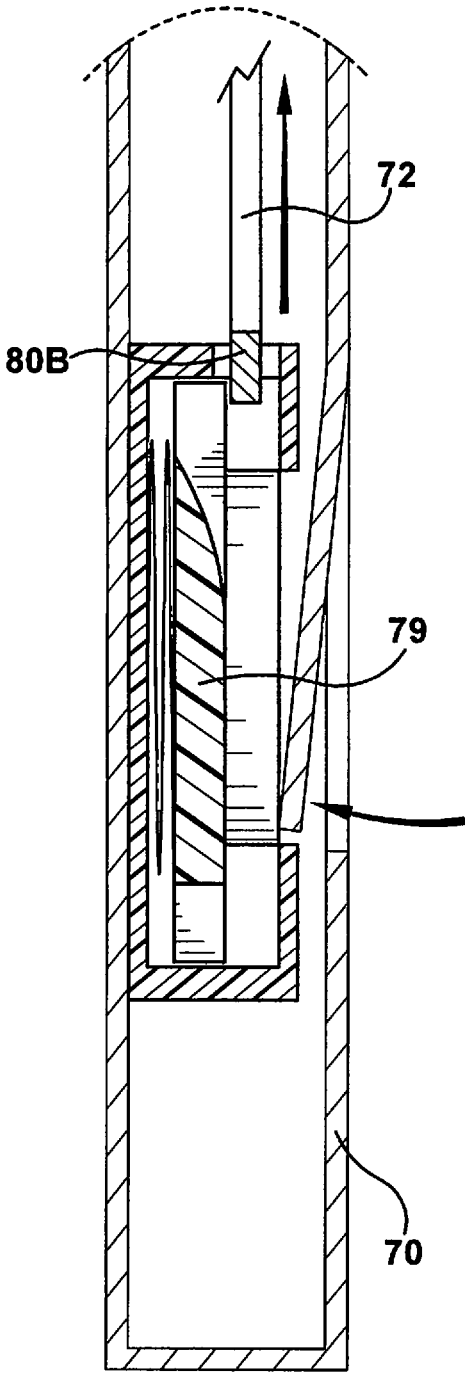
FIG. 22 is a partial cross-sectional view of FIG. 20.

The spring loaded mechanism includes two springs 78A, 78B and a push button 79. The two springs 78A, 78B are attached at a first end to the pop-up panel 72 and at the opposite or second end, to the protective frame 76. When the pop-up panel 72 is in a first position, it is substantially contained within and concealed by the pocket or cavity 70, with the two springs 78A, 78B stretched out between a lower area of the pop-up panel 72 and an upper portion of the frame 76, as shown in FIG. 19. When the pop-up panel 72 is in a second position, it is substantially contained outside of the pocket or cavity 70, and the springs are back to their natural or unstretched state, as shown in FIG. 20. The push button 79, which is accessed through a front surface of the pocket or cavity 70, controls movement of the panel from the first position to the second position. The push button 79 contains an opening or indentation along a bottom surface thereof. A lower area of the pop-up panel 72 contains two opposing inward facing projections 80A, 80B. When the pop-up panel 72 is in the first position, wherein it is contained and concealed within the pocket or cavity 70, the two projections 80A, 80B fit within the opening or indentation along the bottom surface of the push button 79. The push button 79 thereby keeps or holds the pop-up panel 72 in place within the pocket or cavity 70. When the push button mechanism 79 is depressed or pushed inward from the front surface of the greeting card 300, it moves the push button mechanism 79 inward and away from the two projections 80A, 80B on the pop-up panel 72, thereby removing the portion of the push button 79 which keeps the pop-up panel 72 in place within the pocket or cavity 70. Without the push button 79 holding the pop-up panel 72 in place within the pocket or cavity 70, the pop-up panel 72 is released, allowing the stretched springs 78A, 78B to spring back to place, thereby pushing or ejecting the pop-up panel 72 upward and outside of the pocket or cavity 70. Pushing the pop-up panel 72 back down into the cavity or pocket 70 re-secures the pop-up panel 72 to the push button 79 within the cavity or pocket 70. In this particular embodiment, as mentioned above, a mobile object or element 74 is attached to the pop-up panel 72. In a preferred embodiment, the mobile object or element 74 is a substantially planar die cut shape, however, the mobile object or element 74 may also be non-planar and can be any type of relatively thin, lightweight object that is capable of movement by a small motor, such as the one described herein. The mobile object or element 74 is attached to a front surface of the pop up panel 72. A small motor 77 is attached to the die cut shape 74 which effects movement thereof, when activated. The motor 77 is contained within the pocket or cavity 70, concealed from view, regardless of the position of the pop-up panel 72. The motor 77 may be of the type having a rotating arm of shaft, which creates oscillatory motion upon rotating of the shaft by the motor. The motor 77 may alternatively be of the type having a rotating gear mechanism that when activated, turns a circular gear, as shown in FIG. 19. The motor 77 may be of any type small enough to fit into the greeting card 300 and to enable movement of the mobile object 74. The mobile object or element 74 may be attached directly to the motor 77 or via an attachment mechanism or arm. In a preferred embodiment, the press button 79, in addition to initiating propulsion of the pop-up panel 72 from within the pocket or cavity 70 to outside of the pocket or cavity 70, also causes activation of the sound module to initiate playback of the at least one audio file. The sound module is controlled by a small lever 82 which is held in a first position by the pop-up panel 72, when the pop-up panel 72 is in its first position, substantially contained within the pocket or cavity 70. When the press-button 79 is depressed and the pop-up panel 72 moves into the second position, wherein it is substantially outside of the pocket or cavity 70, the lever 82 is released and moves into its second position which allows completion of a circuit, and thereby initiating playback of the at least one audio file saved within the sound module. Pushing the pop-up panel 72 back into the pocket or cavity 70, pushes the lever 82 back to its original position, thereby preventing the completed circuit and deactivating the sound module. The push button 79 also controls activation of the motor module 77 causing movement of the mobile object or element 74. In alternate embodiments, separate switches may be used to activate movement of the pop-up panel 72, and sound and motor 77 module activation. Different switches may be used in place of the press button 79, such as a slide switch, a touch sensitive switch, light sensitive switch, sound sensitive switch, leaf switch, ball switch, or any other type of switch mechanism, known to one with skill in the art. In a preferred embodiment, the press button 79 is accessed through a front surface or panel of the greeting card 300. In practice, pushing the push button 79 causes the pop-up panel 72 to emerge from within the pocket or cavity 70, activation of the motor module 77 causing movement of the mobile object or element 74 and activation of the sound module, causing audio replay of the at least one audio file through the speaker 75. This process resets and repeats itself each time the pop-up panel 72 is pushed back into the pocket or cavity 70 and the push button 79 is again depressed. The mobile object or element 74 may move back and forth, up and down, may rotate or spin or may move in any other type of motion which can be effected by a miniature motor. Pushing the pop-up panel 72 back into the pocket or cavity 70 will cause the sound and motor modules to deactivate. The sound module may also deactivate upon the full completion of the at least one audio file. The motor module 77 may be synchronized to move the mobile object or element 74 in time with the music or song which may be contained on the sound module.

In another embodiment of the pop-up greeting card of the present disclosure and related inventions, shown in FIGS. 23-28, the greeting card contains a manual crank mechanism 82 which controls the movement of a pop-up panel 84 from a first position wherein it is substantially contained and concealed within a pocket inside the greeting card body 81 and a second position wherein it is substantially contained outside of the pocket. Similar to the embodiment described directly above, the pop-up panel 84 contains a mobile element 85 attached thereto that is attached to a motor 86 for effecting movement of the mobile element 85.

As described above with respect to the embodiment shown in FIGS. 1-8, the greeting card body 81 has a front surface 81A, a back surface (not shown) parallel to and spaced apart from the front surface 81A, and right (not shown), left 81C and bottom (not shown) side walls which extend between the front 81A and back surfaces of the greeting card 81, creating a three-sided pocket or cavity therein. A top edge of the pocket or cavity is open to accommodate the insertion and retraction of a pop-up panel 84. The greeting card body 81, in a preferred embodiment, is made of paperboard, cardboard, although other various materials may be used. A protective frame 83 is contained inside the pocket or cavity, for retaining and protecting electronic components of the greeting card 400, a switch or trigger, an activation mechanism, and a pop-up panel 84 and moving element 84. The protective frame 83 can be made from one or more pieces of cardboard or other material having various cut-outs or openings thereon to secure and protect the various internal components of the greeting card 400, as mentioned above. In certain areas where there are no internal components, a piece of foam, cardboard, or other material may be inserted therein to keep a consistent space within the cavity or pocket. The electronic components of the greeting card 400 may include, but are not limited to: a circuit board with integrated circuit chip and controller 87, a memory storage device upon which a least one audio file is saved, a power source, such as one or more batteries 88, a speaker 89, a motor 86, related circuitry and any other electronic component which may be required or which may help facilitate audio playback through the speaker 89, motor movement of a mobile element 85 or any other special effects, such as lights, etc., which are known to one having skill in the art. The greeting card 400 may optionally contain a sentiment panel 96, shown in FIG. 24, which is attached to the left perimeter surface of the greeting card 400 or to the back panel of the greeting card 400. The sentiment panel folds outward away from the greeting card 400 to reveal a message or greeting therein and/or display photos, drawings, pictures or other printing thereon. The sentiment panel 96 gives the greeting card 400 are more traditional look and feel by having a panel which can open and close by pivoting about a fold line to reveal artwork, text sentiment or other printing thereon and by providing a space wherein a consumer can sign his/her name and write a personal message thereon.

Figure 24:
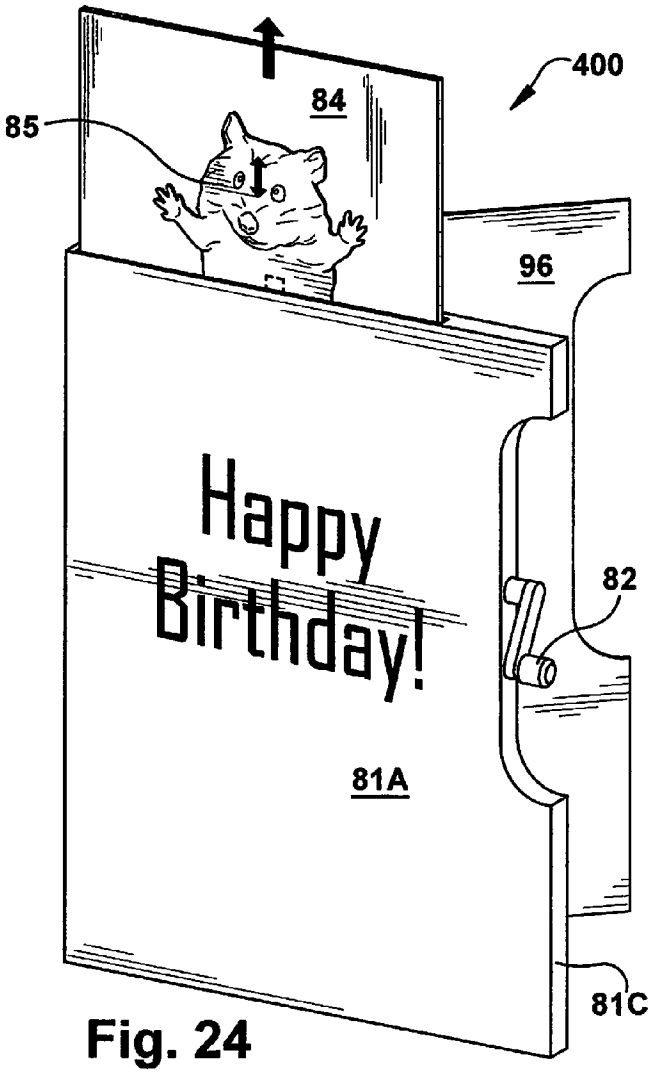
FIG. 24 is a perspective view of the greeting card of FIG. 23, with exposed pop-up panel.
Figure 23:
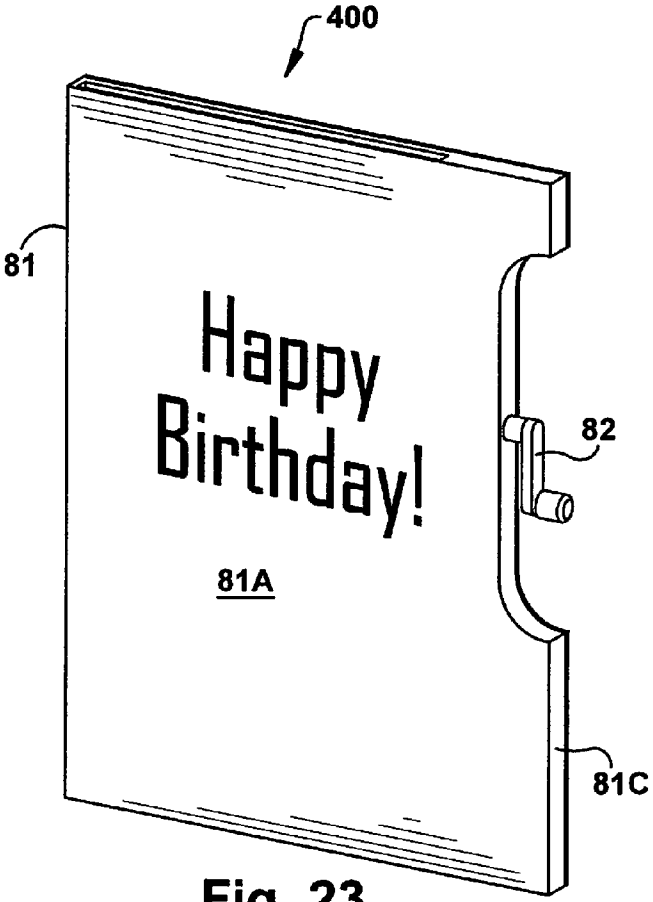
FIG. 23 is a perspective view of an alternate embodiment of the Pop-Up Greeting Card of the present invention.
Figure 25:
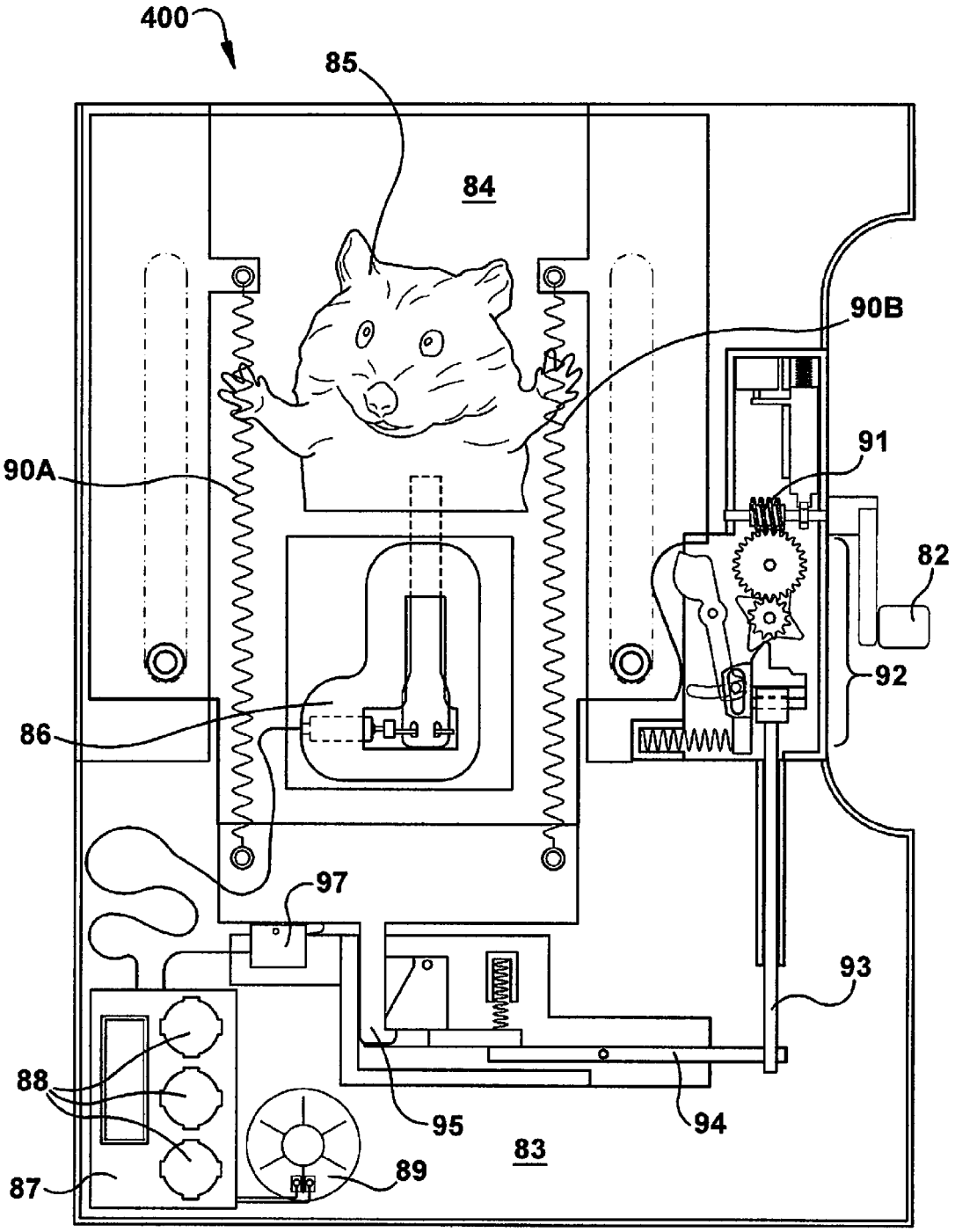
FIG. 25 is a front internal view of the greeting card of FIG. 23, with the crank in a first position and the pop-up panel in a first position.
Figure 26:
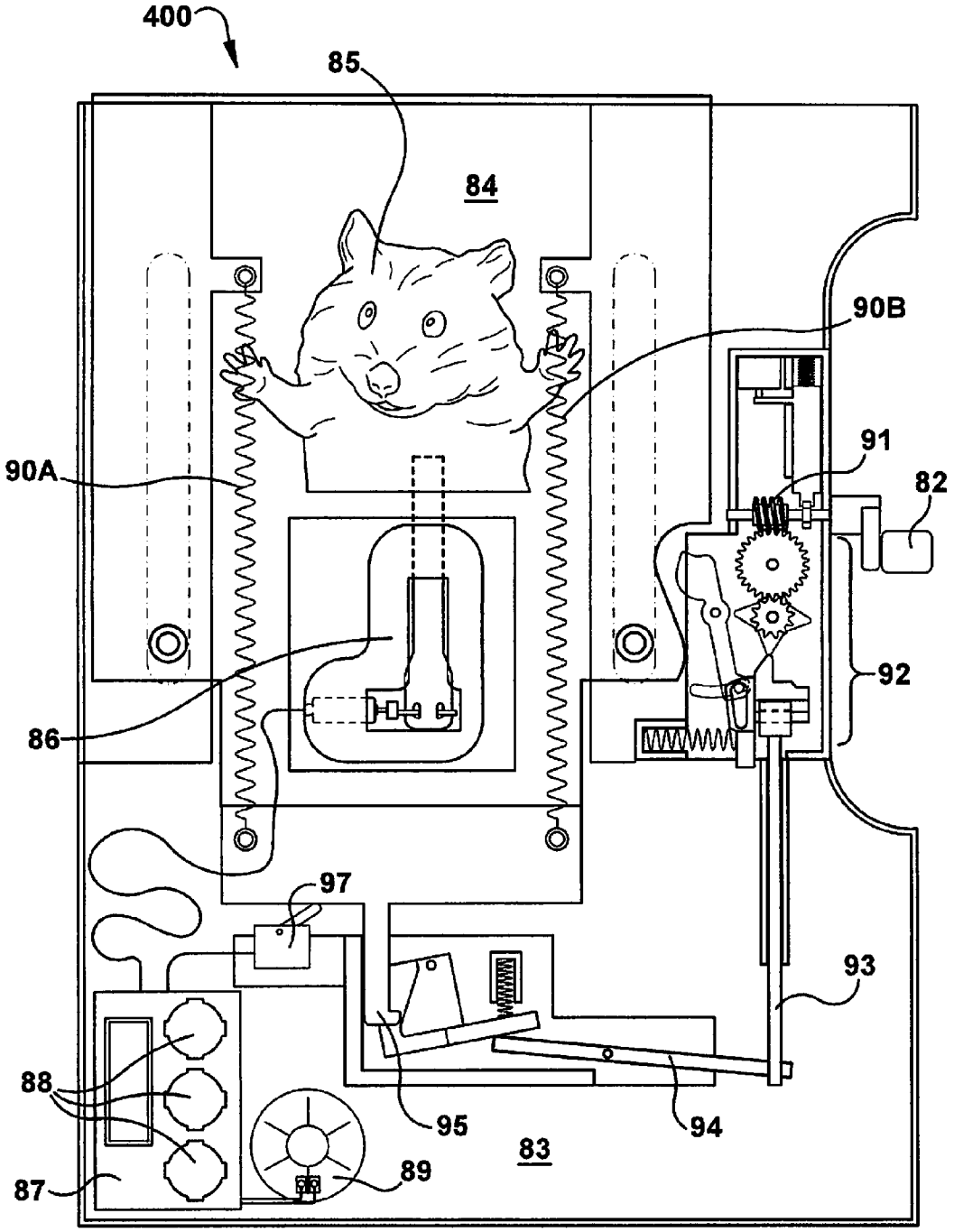
FIG. 26 is a front internal view of the greeting card of FIG. 23, with the crank in a second position and the pop-up panel in a first position.
Figure 27:
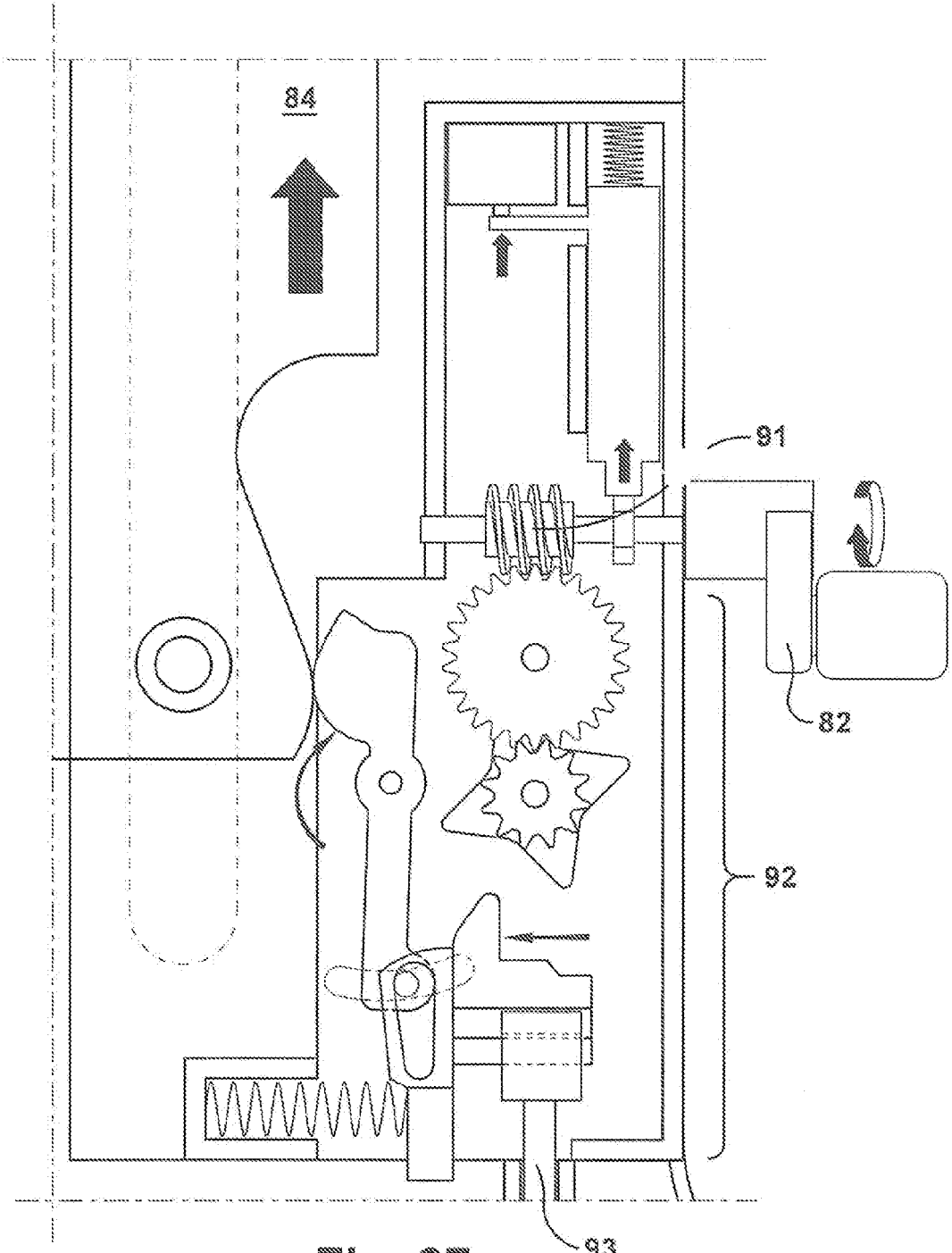
FIG. 27 is a partial close-up front view of the greeting card of FIG. 26.
Figure 28:
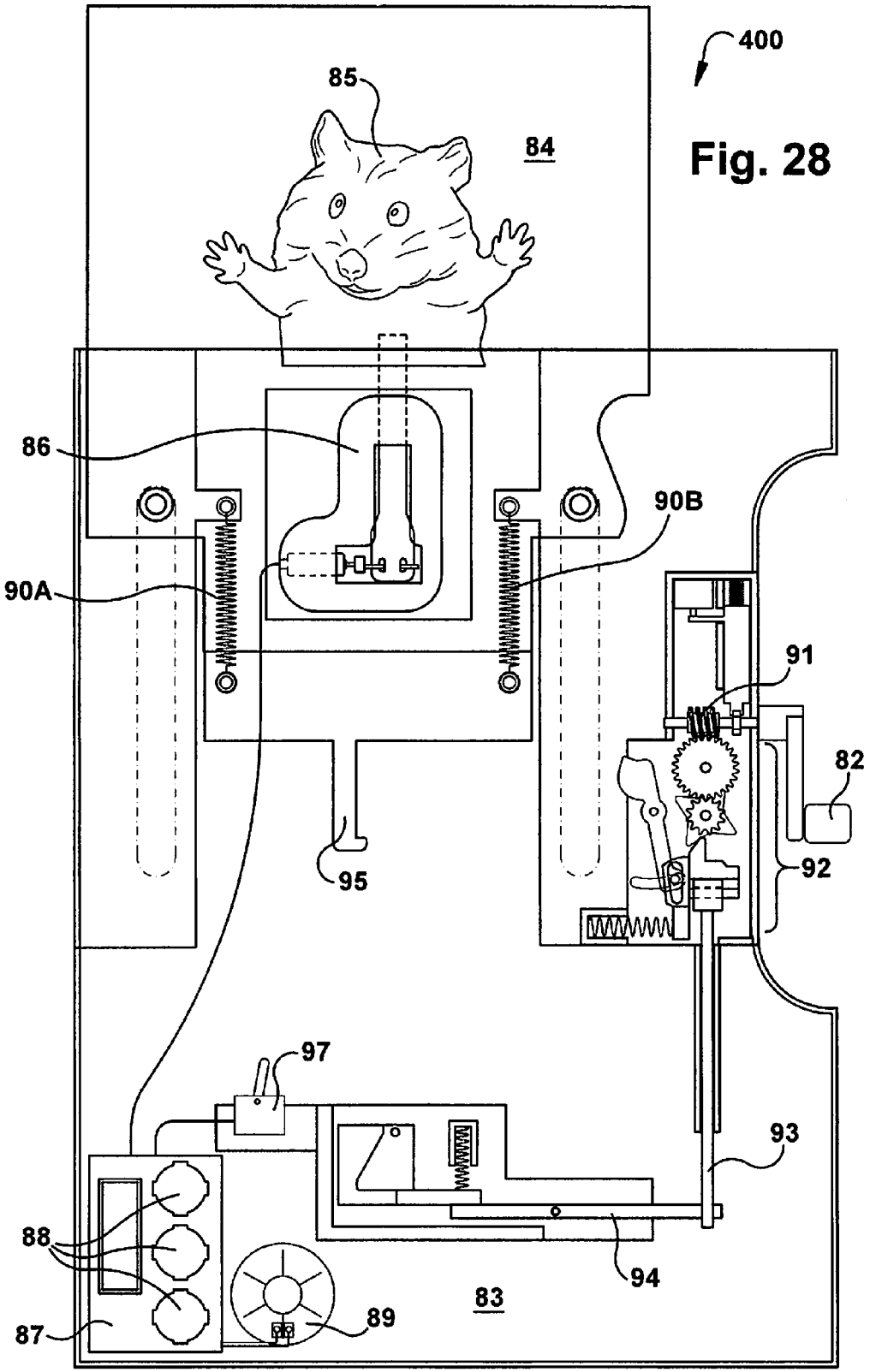
FIG. 28 is a front internal view of the greeting card of FIG. 25, with the crank in a first position and the pop-up panel in a second position.

The pop-up panel 84, in this embodiment, is similar to the pop-up panel 84 described above with respect to the other embodiments, having a substantially planar front and back surface and being appropriately stiff or rigid. The pop-up panel 84 may have text, drawings, artwork or other indicia printed thereon. The panel 84 is positioned between and parallel to the front and back panels of the cavity or pocket. A spring loaded mechanism, shown in FIGS. 25 and 26, which includes two springs 90A, 90B, are attached to the pop-up panel 84. When the pop-up panel 84 is in a first position, it is substantially contained within and concealed by the pocket or cavity, as shown in FIGS. 23, 25, and 26. A mechanical crank mechanism 82 is located along the right side perimeter of the greeting card 400. The crank mechanism 82 is an arm attached at right angles to a rotating shaft 91 by which reciprocating motion is imparted to or received from the shaft 91. It is used to covert circular motion into reciprocating motion or vice-versa, similar to the activation mechanism of a traditional jack-in-the-box children's toy. The rotating shaft 91 works in connection with a gear/spring mechanism 92 (including, but not limited to: one or more gears, a spring, a latch and lever), shown in FIGS. 25-27, which is connected to a vertical rod 93. The vertical rod 93 is connected at a right angle to a horizontal rod 94. The horizontal rod 94 is used as a lever wherein pushing downward on the right end of the horizontal rod 94 causes the left end of the rod to move upward, as shown in FIG. 26. When the left end of the horizontal rod 94 moves upward, it releases a latch or catch arm 95 attached to a bottom surface of the pop-up panel 84. This latch or catch arm 95 holds the pop-up panel 84 inside the greeting card pocket. When the crank 82 is turned (for approximately three full revolutions) by a user, the gear/spring mechanism 92, the vertical 93 and horizontal 94 rods cause release of the latch or catch arm 95, which in turn releases the pop-up panel 84 which is ejected from within the pocket to substantially outside of the pocket, as shown in FIGS. 24 and 28. As noted above, a mobile object or element 85 is attached to the pop-up panel 84. In a preferred embodiment, the mobile object or element 85 is a substantially planar die cut shape, however, the mobile object or element 85 may also be non-planar and can be any type of relatively thin, lightweight object that is capable of movement by a small motor, such as the one described herein. The mobile object or element 85 is attached to a front surface of the pop-up panel 84. A small motor 86 is attached to the mobile object or element 85 which effects movement thereof, when activated. The motor 86 is contained within the pocket, concealed from view, regardless of the position of the pop-up panel 84. The motor 86 may be of the type having a rotating arm of shaft, which creates oscillatory motion upon rotating of the shaft by the motor. The motor 86 may alternatively be of the type having a rotating gear mechanism that when activated, turns a circular gear. The motor 86 may be of any type small enough to fit into the greeting card and to enable movement of the mobile object. The mobile object or element 85 may be attached directly to the motor 86 or via an attachment mechanism or arm. In a preferred embodiment, the crank mechanism 82 initiates propulsion of the pop-up panel 84, activation of the sound module to cause playback of the at least one audio file, and activation of the motor module 86 causing movement of the mobile object or element 85, after three full revolutions of the crank 82, although fewer or more than three revolutions may cause the movement of the pop-up panel 84 and activation of the sound and motor 86 modules. The sound module is activated via a small lever 97 which is held a first position by the pop-up panel 84, when the pop-up panel 84 is in its first position, substantially contained within the greeting card 400. When the pop-up panel 84 is ejected from the greeting card 400 by turning the crank mechanism 82, the lever 97 which controls activation of the sound module is released into a second position, allowing for a completed circuit and initiating playback of the at least one audio file saved on the sound module, as shown in FIG. 28. In alternate embodiments, separate switches may be used to activate movement of the pop-up panel 84, and sound and motor 86 module activation. Different activation mechanisms may be used in place of the crank mechanism, such as a slide switch, a touch sensitive switch, light sensitive switch, sound sensitive switch, leaf switch, ball switch, or any other type of switch mechanism, known to one with skill in the art. In a preferred embodiment, the crank mechanism 82 exits the greeting card on the right perimeter side of the greeting card 400, although it may be placed in any other location on the greeting card 400. Turning the crank 82 causes the pop-up panel 84 to emerge from within the pocket or cavity, activation of the motor module 86 causing movement of the mobile object or element 85 and activation of the sound module, causing audio replay of the at least one audio file through the speaker 89. This process resets and repeats itself each time the pop-up panel 84 is pushed back into the pocket or cavity and the crank 82 is again turned. The mobile object or element 85 may move back and forth, up and down, may rotate or spin or may move in any other type of motion which can be effected by a miniature motor. Pushing the pop-up panel 84 back into the pocket or cavity will cause the sound and motor 86 modules to deactivate. The sound module may also deactivate upon the full completion of the at least one audio file. The motor module 86 may be synchronized to move the mobile object or element 85 in time with the music or song which may be contained on the sound module. Although the sound and motor modules have been described herein as being activated upon three full revolutions of the crank mechanism 82, however, one, two, four or any other number of revolutions may be required to cause the pop-up panel 84 to be ejected from within the pocket and also to activate the sound and motor modules.

In yet another embodiment of the pop-up greeting card of the present disclosure and related inventions, shown in FIGS. 29-32, the greeting card 500 contains a manual lever or arm mechanism 102 which controls the movement of a pop-up panel 103 from a first position wherein it is substantially contained and concealed within a pocket inside the greeting card body 500 and a second position wherein it is substantially contained outside of the pocket. This greeting card 500 also contains lighting effects to simulate the look and feel of a slot machine.

Figure 29:
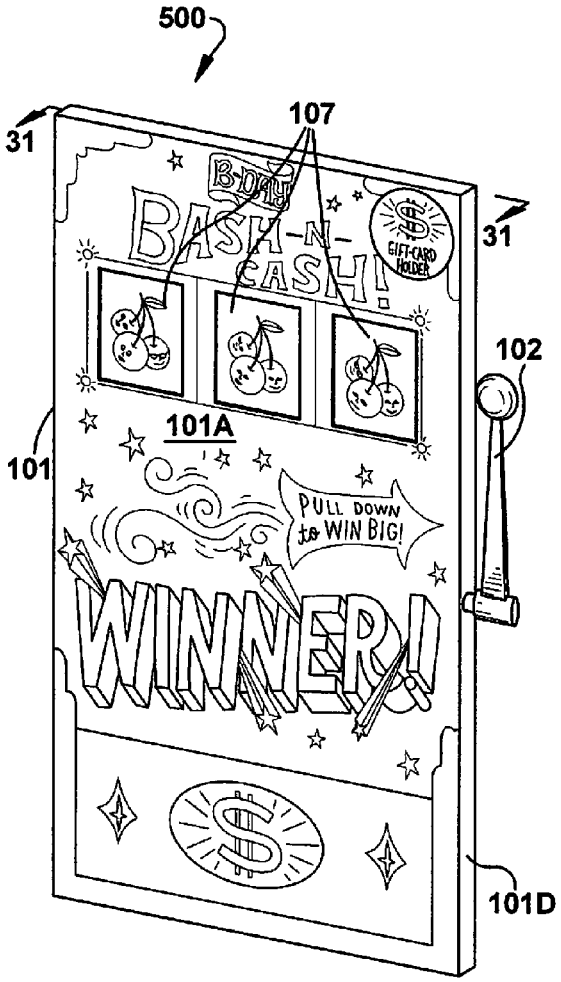
FIG. 29 is a perspective view of an alternate embodiment of the Pop-Up Greeting Card of the present invention.
Figure 30:
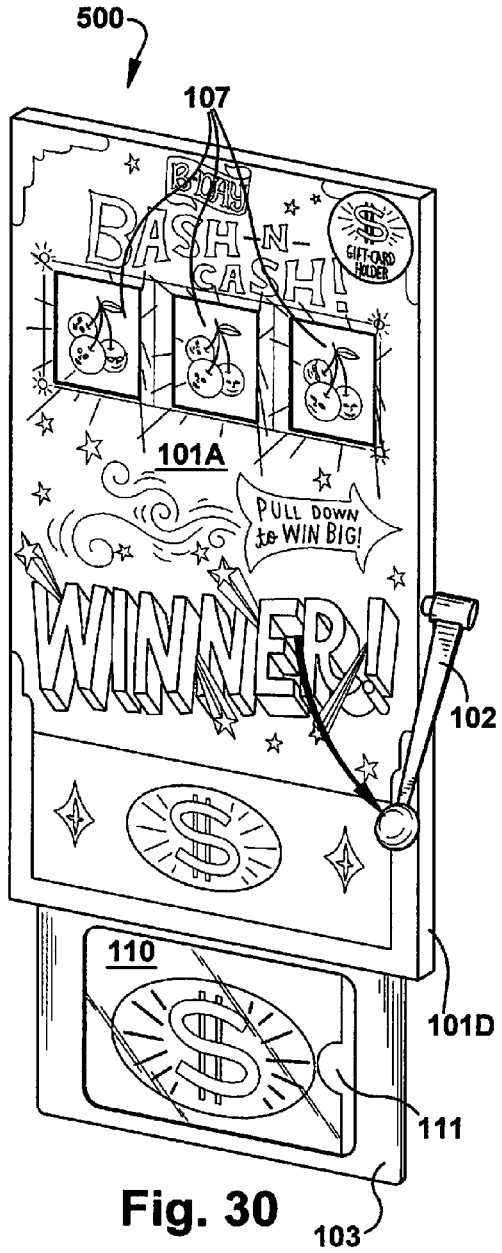
FIG. 30 is a perspective view of the greeting card of FIG. 29, with an exposed pop-up panel with gift card.
Figure 31:
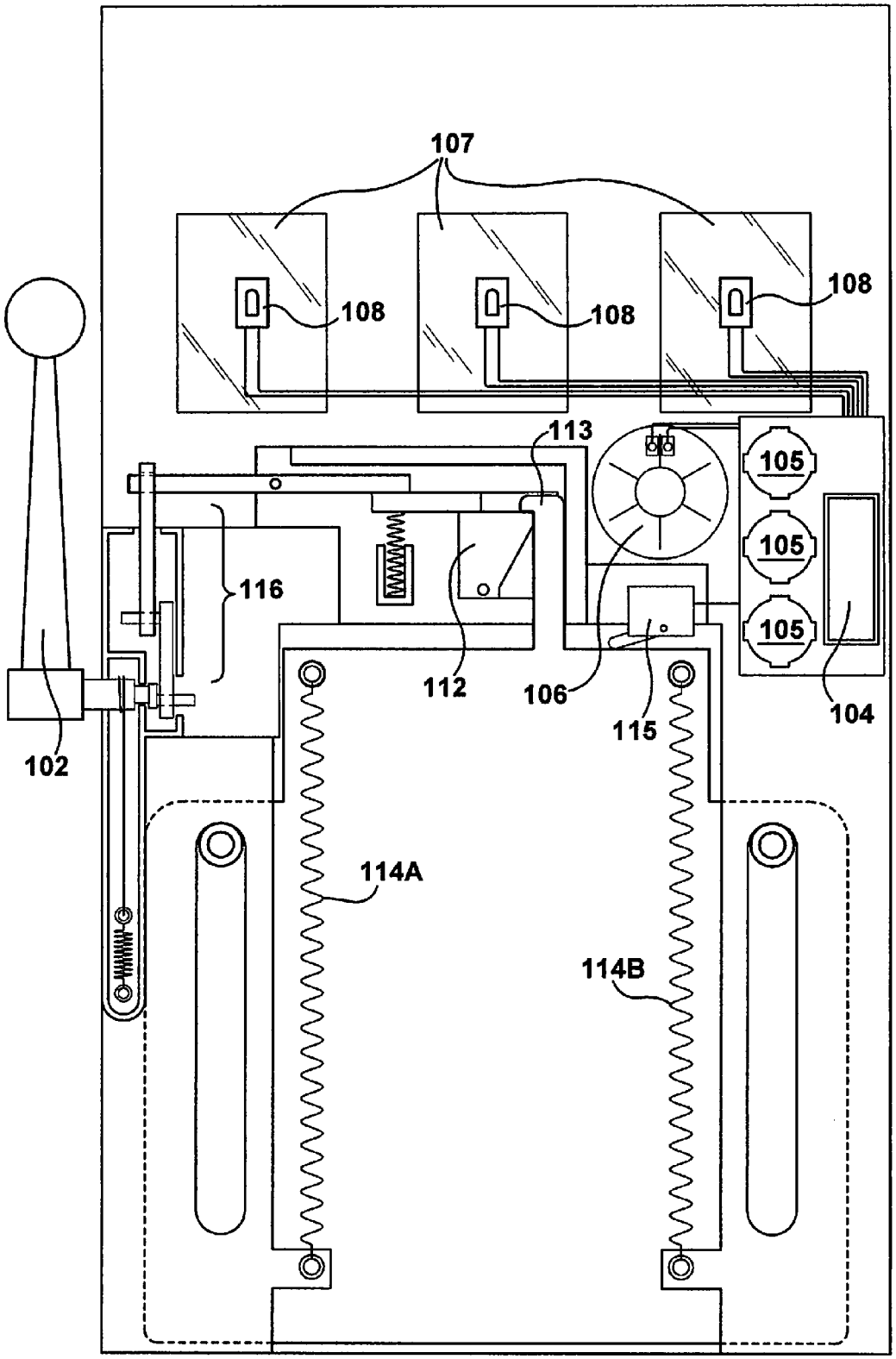
FIG. 31 is a front internal view of the greeting card of FIG. 29, with the pop-up panel in a first position.
Figure 32:
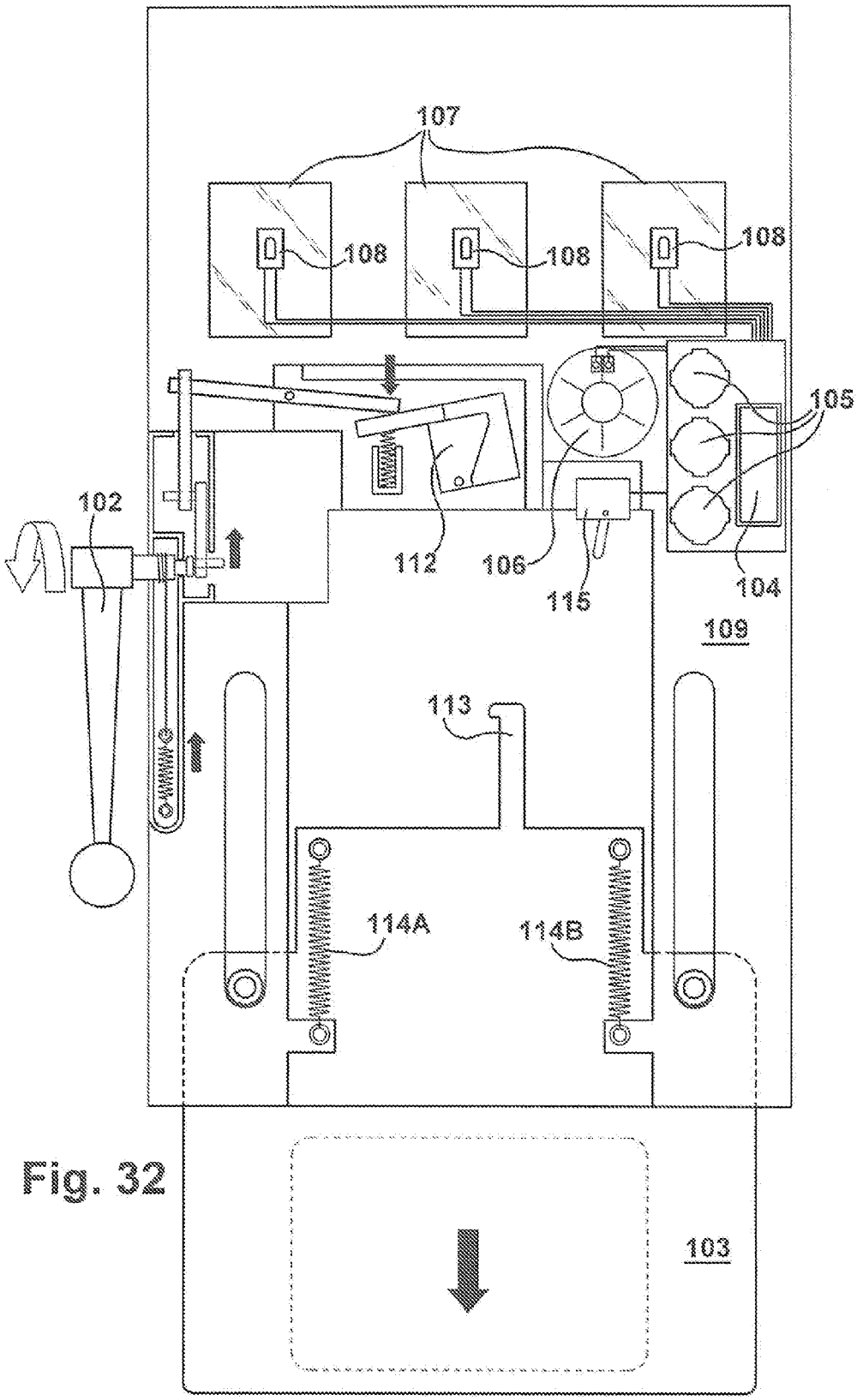
FIG. 32 is a front internal view of the greeting card of FIG. 29, with the pop-up panel in a second position.

As described above with respect to the embodiment shown in FIGS. 1 through 8, the greeting card body 101 has a front surface 101A, a back surface (not shown) parallel to and spaced apart from the front surface 101A, and right (not shown), left 101D, top 101E and bottom side walls which extend between the front 101A and back surfaces of the greeting card 500, creating a three-sided pocket or cavity therein. A top or bottom edge of the pocket or cavity is open to accommodate the insertion and retraction of a pop-up panel 103. The pocket or cavity, in a preferred embodiment, is made of paperboard, cardboard, although other various materials may be used. An optional sentiment panel may be attached to the back edge of the greeting card 500 which may be folded away from the greeting card (like a traditional greeting card) to reveal a message, greeting, drawing, picture, photo, or other printed indicia. A protective frame 109 is contained inside the pocket or cavity, for retaining and protecting electronic components of the greeting card 500, a switch or trigger, an activation mechanism, and the pop-up panel 103. The protective frame 109 can be made from one or more pieces of cardboard or other material having various cut-outs or openings thereon to secure and protect the various internal components of the greeting card, as mentioned above. In certain areas where there are no internal components, a piece of foam, cardboard, or other material may be inserted therein to keep a consistent space within the cavity or pocket. The electronic components of the greeting card may include, but are not limited to: a circuit board with integrated circuit chip and controller 104, a memory storage device upon which a least one audio file is saved, a power source, such as one or more batteries 105, a speaker 106, and related circuitry and any other electronic components which may be required or which may help facilitate audio playback through the speaker 106, motor movement of a mobile element or any other special effects, such as lights, etc., which are known to one having skill in the art. The pop-up panel 103, in this embodiment, is similar to the pop-up panel described above with respect to the other embodiments, having a substantially planar front and back surface and being appropriately stiff or rigid. The pop-up panel 103 may have text, drawings, artwork or other indicia printed thereon. In a preferred embodiment, the pop-up panel 103 contains a pocket thereon 110 into which a standard-size gift card 111 may be inserted, as shown in FIG. 30. A portion of the front surface of the pop-up panel may be transparent so that the greeting card recipient can see the gift card 111 contained within the pocket 110 on the pop-up panel 103. The pop-up panel 103 is positioned between and parallel to the front and back panels of the cavity or pocket of the greeting card 500. A lever or arm 102 is attached to the right perimeter of the greeting card body 101. The vertical lever or arm 102 can be pulled in a downward motion, similar to the motion of pulling the arm of a slot machine. The lever or arm 102 is operative to move the pop-up panel from a first position, wherein it is substantially contained within the cavity or pocket, as shown in FIGS. 29 and 31, and a second position, wherein it is substantially outside of the cavity or pocket, as shown in FIGS. 30 and 32. The vertical lever or arm 102 is attached via one or more segments or rods 116 which are in contact with an attachment lever 112 which holds the pop-up panel 103 in place within the greeting card pocket, via a latch or arm 113 which is attached to the pop-up panel 103. Two springs 114A, 114B are connected between the protective frame 109 and pop-up panel 103 which enable the pop-up panel 103 to spring out of or be ejected from the pocket or cavity in the greeting card 500. When the vertical lever or arm 102 is pulled in a downward direction, the one or more segments or rods 116 tilt or move the attachment lever 112 causing it to tilt and release the pop-up panel 103 so that it can be ejected through the opening in the bottom perimeter surface of the greeting card 500, as shown in FIGS. 30 and 32. The bottom edge of the cavity or pocket is open for the insertion and removal of the pop-up panel 103. Again, the panel 103 may contain a greeting or message, photo or other indicia printed thereon and also contain a pocket therein into which a gift card may be inserted. A gift card may be sold with the greeting card or the greeting card may be sold without the greeting card so that a consumer may insert a gift card of his/her choice. While the preferred embodiment contains a sleeve or pocket 110 having three closed sides and one open side for the insertion and removal of the gift card, which is attached to the pop-up panel 103, the gift card 111 may alternatively be removably attached to the pop-up panel 103 or contained within an envelope which is removably attached to the pop-up panel 103. To further resemble and simulate the actions of a slot machine, the front panel 101A of the greeting card 500 contains, in a preferred embodiment, three openings or windows 107 thereon. Each opening or window 107 may contain a clear, opaque or semi-transparent material which covers each opening. This material may contain printing or outline thereon which may be letters, numbers or symbols, such as, for example, a lemon, a gold bar, a cherry, etc. Beneath this material are one or more lights 108. The lever or arm 102 also controls the illumination of the one or more lights 108. The lights may be activated by a switch 115 having a lever which is held in a first position by the pop-up panel 103 when the pop-up panel 103 is in its first position within the greeting card 500, as shown in FIG. 31. When the pop-up panel 103 is moved into the second position wherein it is outside of the greeting card 500, the movement of the pop-up panel 103 causes the release of the lever 115 into a second position wherein it activates the circuit to cause illumination of the one or more lights 108 in the greeting card 500, as shown in FIG. 32. The lights 108 may simply go on upon pulling the lever 102 or they may blink, twinkle, flash, or perform some other pre-programmed lighting effect. The lights 108 may simply illuminate or reveal the symbols printed or etched onto the material covering the openings or windows 107 on the front panel 101A of the greeting card 500. The switch 115 which controls activation of the lights 108 may additionally initiate audio playback of at least one audio file which is contained on a sound module contained within the greeting card 500. Alternatively, the sound and lights may be initiated by separate switches. In operation, a user pulls downward on the lever or arm 102 located on the right side perimeter 101D of the greeting card 500. This initiates simultaneous audio playback through the speaker 106 within the greeting card 500, lighting effects 108 which are seen through the three windows or openings 107 on the front 101A of the greeting card 500, and movement of the pop-up panel 103 from a first position, wherein the pop-up panel 103 is substantially contained within the pocket or cavity and a second position, wherein the pop-up panel 103 is substantially outside of the pocket or cavity, the pop-up panel 103 revealing a greeting or message or presenting the recipient with a gift card removably attached thereto. While this greeting card embodiment has been described herein as having three openings or windows 107 on the front 101A of the greeting card 500, the greeting card 500 may have less than three openings, at least one opening, three or more openings, or any number of openings or windows 107 thereon. Also, the pop-up panel 103 has been described as being ejected through an opening in the bottom edge 101E of the greeting card cavity or pocket, however, the opening may be along the top edge or either side edge. The lever or arm 102 may be placed elsewhere on the greeting card and may also be replaced by some other manual mechanism while still being in the scope of the present disclosure.

While the embodiments disclosed herein and shown in the figures have a generally square or rectangular shape, the greeting card may take on any conceivable die cut shape. The greeting card may also be made of alternate material such as plastic or foam. Also, the greeting card has been described and shown as having a particular switch which is operative to move the inner greeting card panel(s) from within a main pocket to outside the main pocket, however, any type of switch, such as a touch sensitive switch, a slide tongue switch, a light sensitive switch, a motion sensitive switch, a hand crank, a lever or any other mechanical or electromechanical device may be used. Also, the switch described herein controls both the movement of the inner panel(s) and also playback of an audio file, however, two separate switches may control the movement of the panel(s) and the playback of audio.

All of the embodiments described herein may additionally contain a USB port, SD card slot or other external memory device port for receiving or uploading audio files from an external source such as a personal computer. The greeting card embodiments disclosed herein may also contain a sentiment panel which is attached to a front or back surface or side of the main pocket or panel and serves as a traditional greeting card that is folded along a fold line and opened along said fold line to reveal a message, artwork, etc. Other additional features which have been contemplated are a microphone for recording a personalized user message for playback upon activation of the press button or other such switch; a motor module for mechanical movement of one or more movable elements which are attached in some way to the greeting card; and one or more LED lights which are visible through the front of the greeting card and which are illuminated upon pressing the press button or other such switch. Combination of the above-mentioned additional special effects or features have also been contemplated and are considered to be within the scope of the present invention. One or more features of the various embodiments described above may also be combined to form yet another embodiment which is considered to be within the scope of the present disclosure and related inventions.

The disclosure and related inventions thus provide novel card constructions and operations which can be constructed inexpensively and efficiently, and advantageously from primarily paperboard materials configured to securely hold mechanical and electronic components to enable a wide variety of functions and features which enhance the effectiveness of the card as a communication and entertainment device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A pop-up greeting card comprising:

a main pocket having a front side, a back side parallel to and spaced apart from the front side, and a right side, left side and bottom panel which extend between the front and back sides;

a single pop-up panel which is operative to move from a first position wherein the pop-up panel is substantially contained within the main pocket and a second position wherein the pop-up panel is substantially outside of the main pocket;

at least one opening on the front side of the main pocket, the at least one opening being covered by a transparent or semi-transparent material;

at least one LED light contained within the main pocket behind the at least one opening on the front side of the main pocket;

a lever attached to the right or left side of the main pocket, the lever operative to move the pop-up panel from the first position to the second position and also to illuminate the at least one LED light, when the lever is pulled in a downward direction.

2. The pop-up greeting card of claim 1, wherein the pop-up panel contains a gift card removably attached thereto.

3. The pop-up greeting card of claim 1, wherein there are three openings covered by a transparent or semi-transparent material on the front side of the main pocket, each of the three openings having at least one LED light contained therebehind.

4. The pop-up greeting card of claim 1, wherein the at least one LED light flashes upon pulling the lever in a downward direction.

5. The pop-up greeting card of claim 1 further comprising a sound module operative to store and play back at least one audio file.

6. The pop-up greeting card of claim 1, wherein the pop-up panel exits the main pocket through the bottom panel.

7. A greeting card comprising a multi-panel greeting card body comprising a pocket having an opening on a lower most edge thereof;

a panel which is operative to move between a first position wherein it is concealed within the multi-panel greeting card body and a second position wherein it is substantially outside of the multi-panel greeting card body;

at least one LED light, the at least one LED light contained behind a transparent or semi-transparent material;

a lever, which when pulled in a downward direction, moves the panel from the first position to the second position and which causes illumination of the at least one LED light.

8. The greeting card of claim 7, wherein there are three LED lights.

9. The greeting card of claim 8, wherein the three LED lights are contained behind semi-transparent material.

10. The greeting card of claim 7, wherein the panel has a gift card removably attached thereto.

11. The greeting card of claim 7 further comprising a sound module operative to store and playback at least one audio file through a speaker.

12. The greeting card of claim 11, wherein the lever controls activation of the sound module.

13. The greeting card of claim 11, wherein pushing the panel back into the multi-panel greeting card body silences the playback of the at least one audio file through the speaker.

14. The greeting card of claim 7, wherein the panel exits the greeting card through an opening in a bottom edge thereof.

15. A greeting card comprising:

a greeting card body having four sides, one closed end and one open end, the open end being located at a lowermost edge thereof;

a gift card holder contained within the greeting card body operative to move between a first position wherein the gift card holder is contained inside the greeting card body and a second position wherein the gift card holder is outside the greeting card body;

a lever located on an outside surface of the greeting card body;

wherein pulling the lever in a downward direction moves the gift card holder from the first position to the second position and illuminates the one or more lights.

16. The greeting card of claim 15 further comprising a sound module operative to store and playback at least one audio file through a speaker.

17. The greeting card of claim 16, wherein the lever controls activation of the sound module.

18. The greeting card of claim 15, wherein the gift card holder contains a gift card therein.

19. The greeting card of claim 15 further comprising one or more lights contained thereon.

* * * * *